US009428997B2

(12) United States Patent
Broussard et al.

(10) Patent No.: US 9,428,997 B2
(45) Date of Patent: Aug. 30, 2016

(54) MULTI-ZONE BYPASS PACKER ASSEMBLY FOR GRAVEL PACKING BOREHOLES

(71) Applicant: Weatherford/Lamb, Inc., Houston, TX (US)

(72) Inventors: John P. Broussard, Kingwood, TX (US); Christopher A. Hall, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 262 days.

(21) Appl. No.: 14/022,959

(22) Filed: Sep. 10, 2013

(65) Prior Publication Data

US 2015/0068743 A1 Mar. 12, 2015

(51) Int. Cl.

| | |
|---|---|
| ***E21B 43/08*** | (2006.01) |
| ***E21B 23/06*** | (2006.01) |
| ***E21B 33/124*** | (2006.01) |
| ***E21B 43/04*** | (2006.01) |
| ***E21B 33/126*** | (2006.01) |
| ***E21B 33/128*** | (2006.01) |
| ***E21B 43/14*** | (2006.01) |

(52) U.S. Cl.

CPC ..... *E21B 43/04* (2013.01); *E21B 33/124* (2013.01); *E21B 33/126* (2013.01); *E21B 33/128* (2013.01); *E21B 43/14* (2013.01)

(58) Field of Classification Search

CPC ..... E21B 23/06; E21B 33/124; E21B 43/04; E21B 43/08; E21B 43/045

See application file for complete search history.

(56) References Cited

U.S. PATENT DOCUMENTS

| | | | |
|---|---|---|---|
| 4,945,991 | A | 8/1990 | Jones |
| 5,113,935 | A | 5/1992 | Jones et al. |
| 5,515,915 | A | 5/1996 | Jones et al. |
| 6,227,303 | B1 | 5/2001 | Jones |
| 6,298,916 | B1 | 10/2001 | Tibbles et al. |
| 6,736,210 | B2 | 5/2004 | Hosie et al. |
| 7,562,709 | B2 | 7/2009 | Saebi et al. |
| 2010/0032158 | A1 | 2/2010 | Dale et al. |
| 2010/0155064 | A1 | 6/2010 | Nutley et al. |
| 2010/0236779 | A1 | 9/2010 | Nutley et al. |
| 2011/0203793 | A1 | 8/2011 | Tibbles |
| 2013/0161000 | A1 | 6/2013 | Broussard et al. |
| 2013/0248172 | A1* | 9/2013 | Angeles Boza et al. ..... 166/250.01 |

FOREIGN PATENT DOCUMENTS

| | | |
|---|---|---|
| WO | 2007092082 | 8/2007 |
| WO | 2007092083 | 8/2007 |
| WO | 2010054407 | 5/2010 |

* cited by examiner

*Primary Examiner* — Catherine Loikith
(74) *Attorney, Agent, or Firm* — Blank Rome, LLP

(57) ABSTRACT

A gravel pack assembly includes screen sections with a packer between them. A first screen section communicates an uphole annulus with the assembly's interior passage, and a second screen section communicates a downhole annulus with the interior passage. A housing of the packer has an internal bore communicating with the assembly's interior passage and has an internal bypass communicating external ports with one another. A first packer element disposed between the external ports restricts gravel passage at least from the uphole to the downhole annulus. A second packer element disposed downhole from a second of the external ports is independently actuated to isolate fluid passage between the uphole and downhole annulus. One or more transport tubes communicate slurry from the uphole annulus to the internal bypass once the uphole annulus is packed with gravel.

28 Claims, 17 Drawing Sheets

MULTI-ZONE BYPASS PACKER ASSEMBLY FOR GRAVEL PACKING BOREHOLES

BACKGROUND OF THE DISCLOSURE

In the field of oil and gas exploration and production, it is common for sand and other fine solid particles to be present in reservoir fluids. These particles are highly abrasive and cause damage to the well components. Therefore, in many formations, it is necessary for the wellbore completion to control the sand and other fine particles that enter the production tubing and are brought to surface with the production fluid. A wide range of sand control technologies are used in the industry, and typically comprise a system of sand control devices (such as sand screens) displaced along the completion string that filter sands and fine particles from the reservoir fluids. In the end, the sand control devices prevent the particulate from entering the production tubing.

Sand control devices are typically used in conjunction with one or more gravel packs, which comprise gravel or other particulate matter placed around the sand control device to improve filtration and to provide additional support to the formation. In a gravel pack operation, for example, a slurry of gravel solids in a carrier fluid is pumped from surface along the annulus between the sand control device and the open or cased hole. The gravel then preferably packs with a good distribution in the annulus at the sand control device.

In many subterranean formations, a wellbore may pass through multiple hydrocarbon bearing zones that are of interest to the operator so that it may be necessary to gravel pack the individual zones. An example of a multi-zone completion system is shown in FIG. 1. The system 100 includes a production facility at surface, which in this case is a floating production storage and offloading (FPSO) vessel 102, coupled to a wellbore 104 via a subsea tree 106. The wellbore 104 in this case is a deviated wellbore that extends through multiple production zones or intervals 107*a-c* in the formation 108. The production tubing 110 provides a continuous flow path that penetrates through the multiple zones 107*a-c*.

The production tubing 110 can be provided with ports or inflow control devices (not shown) that allow production fluid to flow into the production tubing 110 and uphole to the subsea tree 106. To provide control over the production process, the annulus 112 is sealed by packers 114 between the different production zones 107 to prevent fluid flowing in the annulus between the different zones. Sand control devices 116 prevent solid particles of the gravel pack and the formation from entering the production tubing 110.

In a conventional approach to sand control, a gravel pack is installed across the first isolated zone 107*c* by running gravel pack tools in a dedicated gravel pack operation. Subsequently, in a separate gravel pack operation, a gravel pack is installed across an adjacent isolated zone 107*b*. The procedure can be performed multiple times to place gravel packs across all of the zones of interest.

In some formations where adjacent zones are particularly close together, it may not be possible to perform separate gravel pack operations in this manner. Moreover, even where it is possible to perform separate gravel pack operations, it is generally desirable to install gravel packs across all of the zones of interest in a single trip when multiple production zones are in close proximity to one another. Tool systems and methods for achieving this are referred to as single trip multi-zone systems. In these methods, the gravel pack slurry is pumped with the gravel pack tools positioned across each of the intended zones, and the gravel is placed across multiple zones in a single trip, but with distinct and separate pumping operations for each zone.

These single trip multi-zone systems reduce the overall time of the gravel pack operation significantly, but they do suffer from some major disadvantages. For example, the operations are complicated and require a lot of specialized equipment to be installed into the wellbore. Service tools must be repositioned for gravel packing each zone, and pumping must be stopped upon the completion of one zone and then restarted when the tools have been positioned at the next zone.

To improve the delivery of gravel slurries, sand control devices have been provided with shunt tubes, which create alternate flow paths for the gravel and its carrier fluid. These alternate flow paths significantly improve the distribution of gravel in the production interval, for example, by allowing the carrier fluid and gravel to be delivered through sand bridges that may form in the annulus before the gravel pack has been completed. Examples of shunt tube arrangements can be found in U.S. Pat. Nos. 4,945,991 and 5,113,935. The shunt tubes may also be internal to the filter media, as described in U.S. Pat. Nos. 5,515,915 and 6,227,303.

U.S. Pat. No. 6,298,916 describes a multi-zone packer system that has an arrangement of cup packers with shunt tubes used in a gravel pack operation. An upper packer is bypassed by a crossover device to deliver the gravel pack slurry to a first production zone, and the shunt tubes allow the slurry to be placed at the subsequent zones beneath the zonal isolation packers. U.S. Pat. No. 7,562,709 describes an alternative method in which the zonal isolation is achieved by the use of swellable packers, which include a mantle of swellable elastomeric material formed around a tubular body. Shunt tubes run underneath the swellable mantle to allow the gravel pack slurry to bypass the isolation packers.

It is also proposed in WO 2007/092082 and WO 2007/092083 to provide packers with alternate path mechanisms that may be used to provide zonal isolation between gravel packs in a wellbore. Embodiments described in WO 2007/092082 and WO 2007/092083 include packers with swellable mantles that increase in volume on exposure to a triggering fluid. US 2010/0155064 and US52010/0236779 also disclose the use of swellable isolation devices in shunt tube gravel packing operations. US52011/0203793 is yet another example that uses cup packers and swellable isolation devices.

Although the shunt tube systems allow zonal isolation in gravel pack operations, the reliance on shunt tubes as a bypass mechanism for gravel slurry placement is undesirable. Reliance on shunt tubes adds to the general complexity of the completion and installation operation. For example, the shunt tubes must be aligned and made up to jumper tubes of adjacent sand control devices when the production tubing is assembled. The use of shunt tubes may also cause complications for maintaining the required annular barrier or fluid seal functions of the isolation packers, as they are required to expand around shunt tubes.

In swellable elastomer systems, problems may arise due to removal of a volume of elastomer from the isolation device, improper sealing around the shunt tubes, displacement of the conduits due to expansion of the element, and/or coupling of the conduits at opposing ends of the isolation device. Accommodation of shunt tubes may necessitate a reduction in the overall volume of the expanding element, and in particular a reduction in the volume of the expanding element which is radially outward of the shunt tube. A shunt tube system with swellable isolation may therefore take longer than desirable to achieve a seal and/or may not have sufficient pressure sealing performance. Mitigating these problems may require the run-in diameter of the swellable packer to be increased, which can impact on the success of deployment operations, or reduction in the effective production bore size, which is detrimental to production rates.

While the use of swellable elastomer packers and isolation devices have several advantages over conventional packers including passive actuation, simplicity of construction, and robustness in long term isolation applications, their use in conventional gravel pack applications described above may increase the time taken to perform the entire gravel pack operation. This is because in a conventional approach, the isolation devices are set against the wall of the open or cased hole to isolate the zones prior to placement of the gravel pack. This sequence means that the gravel pack cannot be placed until the swellable isolation device has swollen, which in many cases may be a number of days. This introduces a delay before pumping of the gravel slurry which may be undesirable to the operator.

Particular implementations for mitigating at least some of the above issues are disclosed in US2013/0161000, filed 23 Dec. 2011 by John Broussard, Brian Nutley, Ross Clarke, and Kim Nutley, and entitled "Downhole Isolation Methods and Apparatus Therefor," which is incorporated herein by reference in its entirety. Although these implementations are effective, operators are continually striving for versatile techniques for gravel packing and isolating multiple sections of a borehole.

The subject matter of the present disclosure is directed to overcoming, or at least reducing the effects of, one or more of the problems set forth above.

SUMMARY OF THE DISCLOSURE

A two element packer apparatus uses one packer to serve as a barrier to annular flow during a gravel pack operation. This barrier packer is placed between upper and lower zones in a borehole. In one embodiment, a bypass flow area internal to the packer apparatus connects to one or more transport tubes attached to the screens across the upper zone. Gravel packing the upper zone can then take place in a normal fashion with the slurry dehydrating through the upper screen section. Once the upper screen section is covered, the slurry diverts into the transport tubes and flows through the bypass of the packer apparatus, entering the annulus around the lower screen section for the lower zone to be gravel packed. The slurry is pumped until an increase in pressure indicates that the lower screen section is covered with slurry. At this point, a second packer on the apparatus expands and seal against the borehole wall or casing in a void space below the first packer.

The packer apparatus can be used for cased and open hole applications. For cased holes, the upper packer can be a cup packer to form a friction seal with the surrounding casing wall. Thus, the cup packer can act as a barrier at least to the gravel from the slurry during gravel packing of the upper zone. The packer apparatus can be adapted for open hole applications by making the upper packer hydraulically or hydrostatically-actuated with a compressible packing element that expands enough to seal on the irregularities of an open hole. This arrangement could also be used in a cased hole.

The second packer can be a swellable packer, a mechanically-actuated packer, a hydraulically-actuated packer, or a hydrostatically-actuated packer. However, either one or both of these first and second packers can be actuated through the use of radio-frequency identification (RFID) tags or pressure pulse signals. Preferably, the second packer has a compressible packing element and is independently compressible to isolate fluid passage between the uphole and downhole annulus portions.

In another embodiment, gravel packing an annulus of a borehole with gravel communicated in a slurry starts with sealing a section of a washpipe in an internal passage of an assembly disposed in a borehole. Slurry is communicated down the annulus around the assembly disposed in the borehole, and passage of at least the gravel is restricted with a first packer element from an uphole portion of the annulus to a downhole portion of the annulus. However, the slurry can communicate from the uphole annulus portion to the downhole annulus portion through an internal bypass on the assembly.

The gravel from the slurry packs around a downhole screen section on the assembly in the downhole annulus portion, and the internal passages of the washpipe takes the fluid returns from the slurry. Eventually, a port on the washpipe is opened uphole of the washpipe's sealed section in the first internal passage of the assembly. At this point, the gravel from the slurry packs around an uphole screen section on the assembly in the uphole annulus portion. The fluid returns from the slurry are taken in through the washpipe's open port and up the internal passage of the washpipe. In the end, fluid communication can be isolated between the uphole and downhole annulus portions by activating a second packer element disposed on the assembly between the uphole and downhole screen sections.

The foregoing summary is not intended to summarize each potential embodiment or every aspect of the present disclosure.

and a hydraulically-actuated, compression-set packer for the disclosed gravel pack assembly.

Figure 7A:
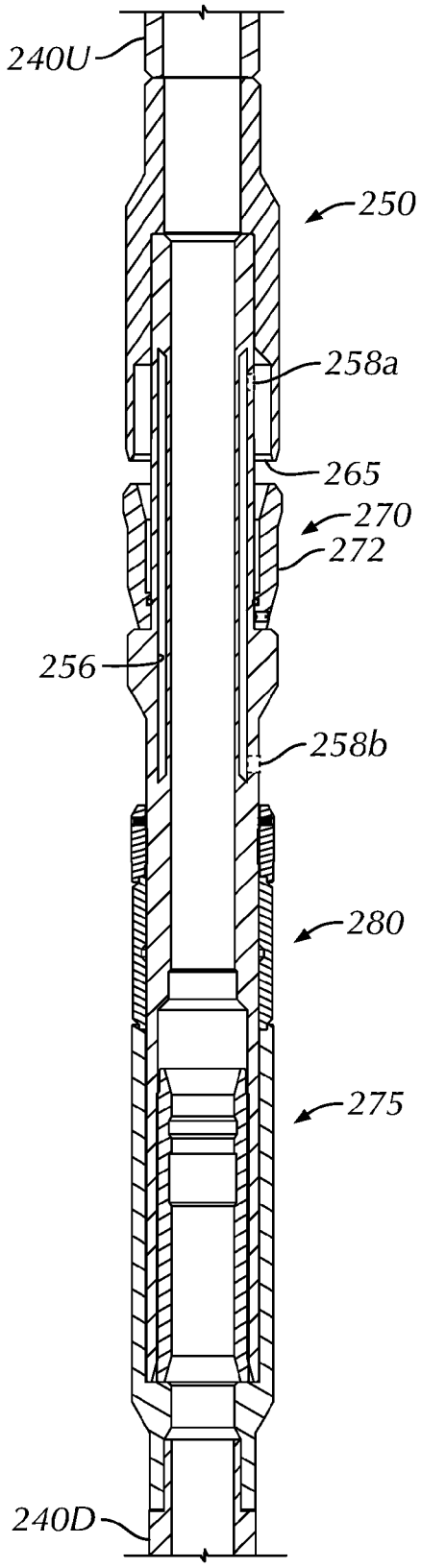
FIG. 7A illustrates an embodiment of a concentric bypass packer apparatus having a concentric bypass; a cup packer; and a mechanically-actuated, compression-set packer for the disclosed gravel pack assembly.
Figure 7B:
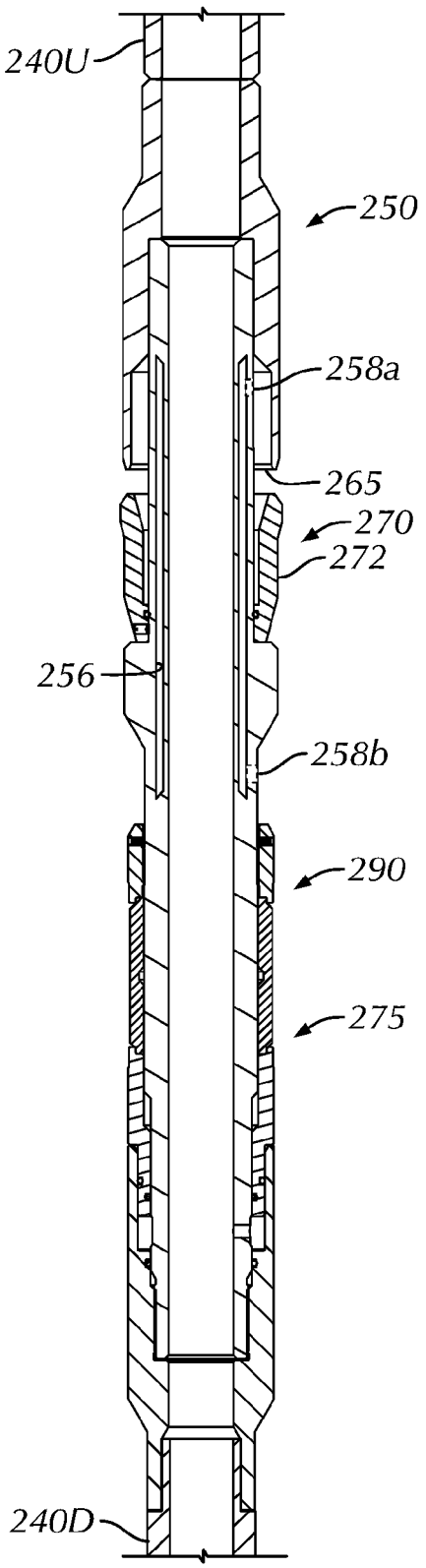
FIG. 7B illustrates an embodiment of a concentric bypass packer apparatus having a concentric bypass; a cup packer.
Figure 7C:
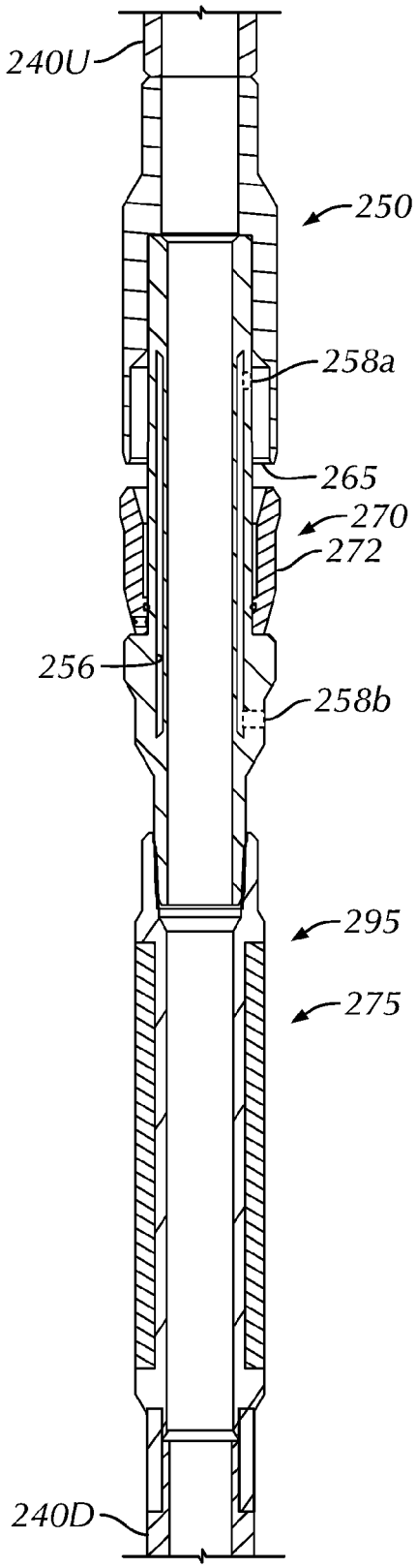

FIG. 7C illustrates an embodiment of a concentric bypass packer apparatus having a concentric bypass, a cup packer, and a swellable packer for the disclosed gravel pack assembly.

Figure 5:
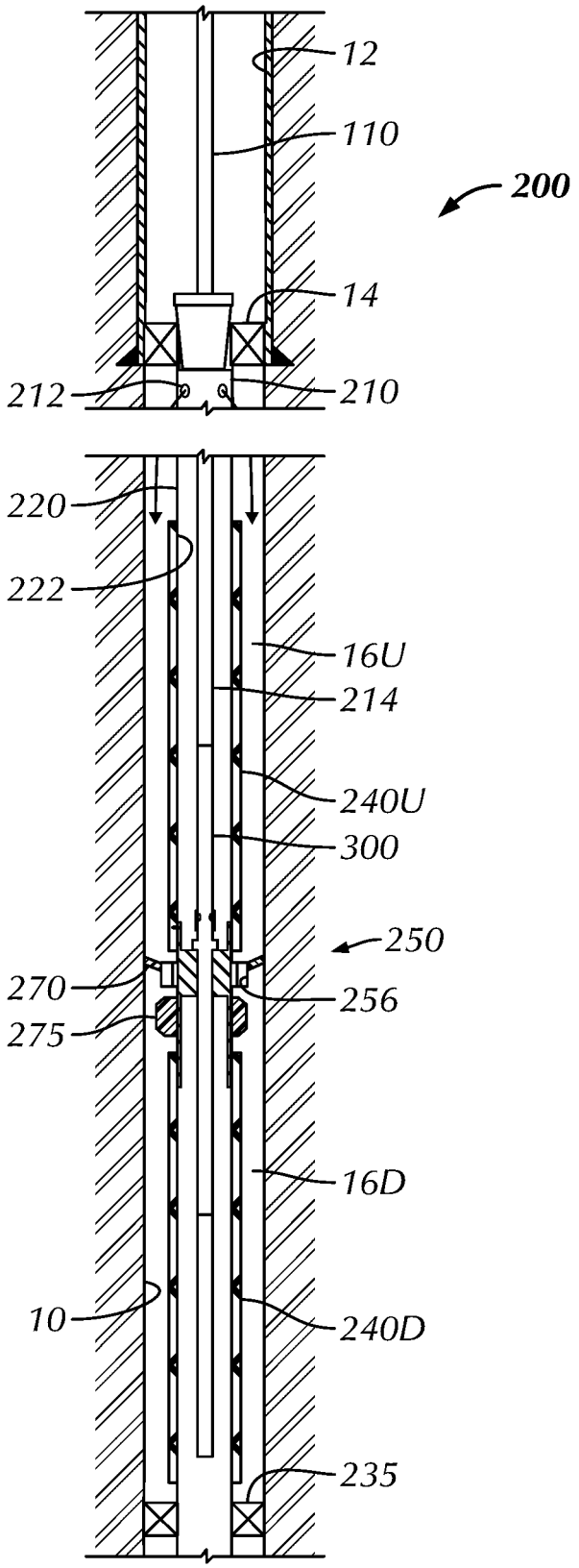
FIG. 5 illustrates a schematic view of a gravel pack assembly according to another embodiment of the present disclosure.
Figure 6A:
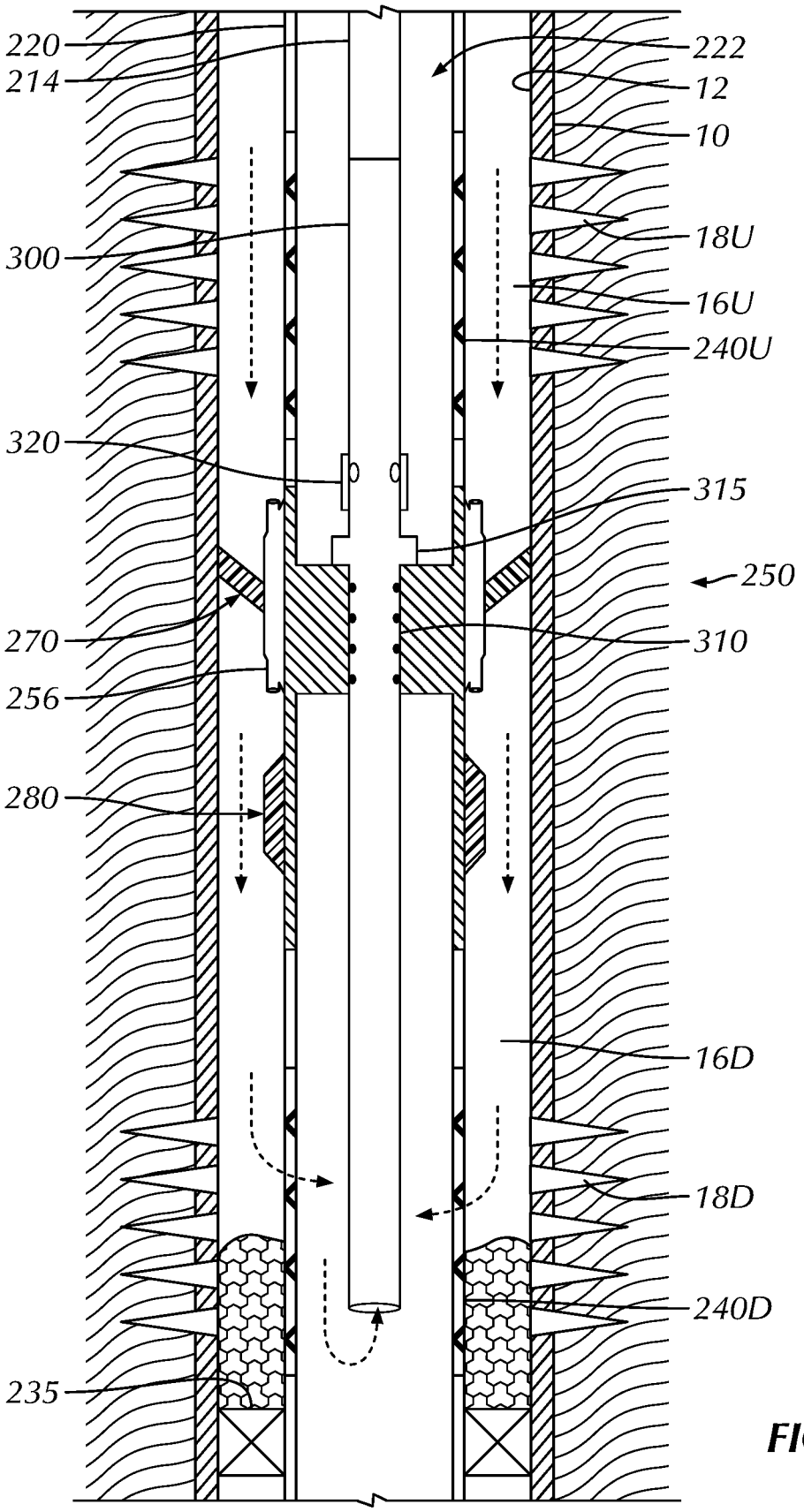
FIGS. 6A-6B illustrate portions of the gravel pack assembly in FIG. 5 during stages of a gravel pack operation.
Figure 6B:
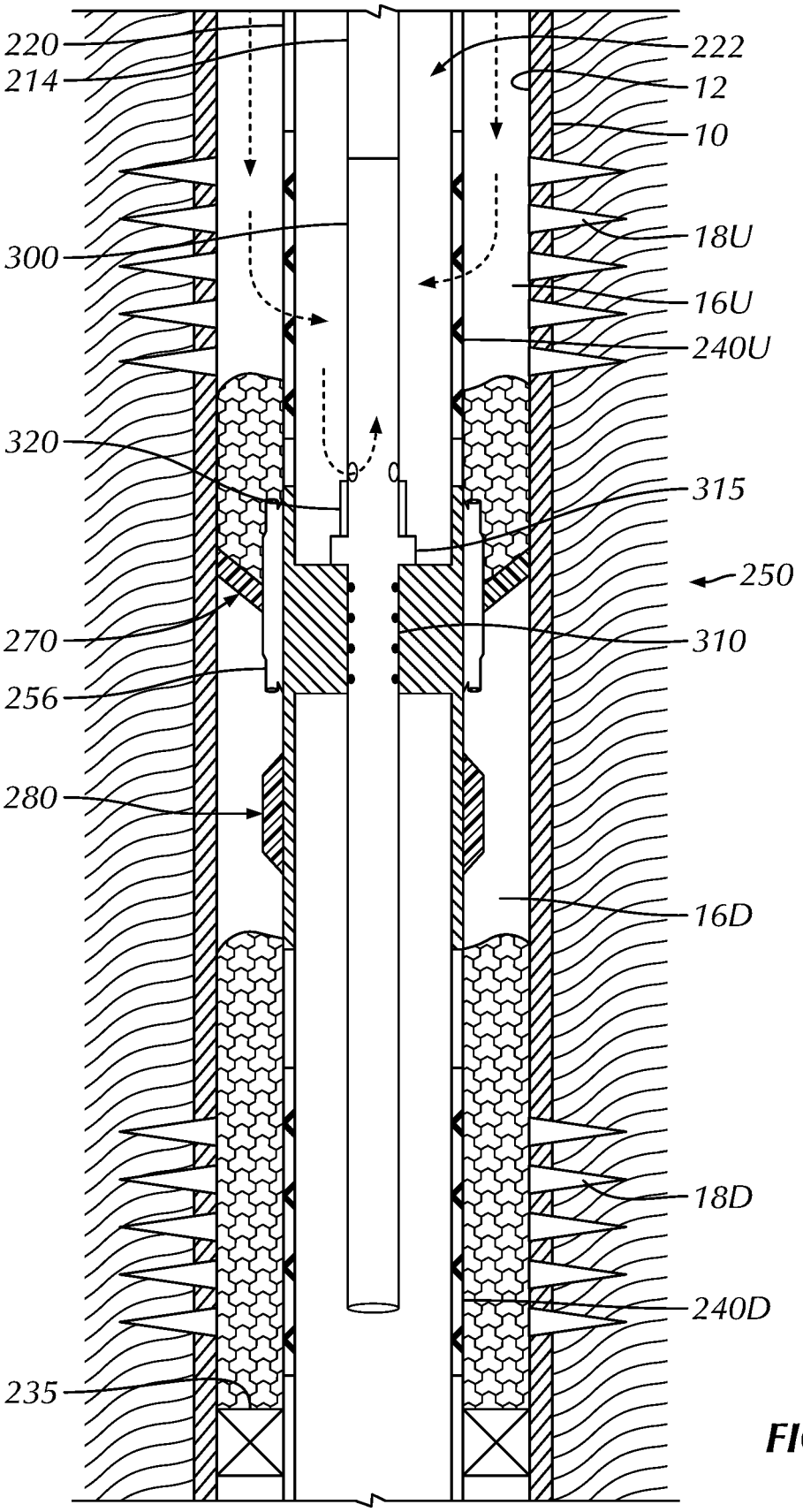
Figure 8A:
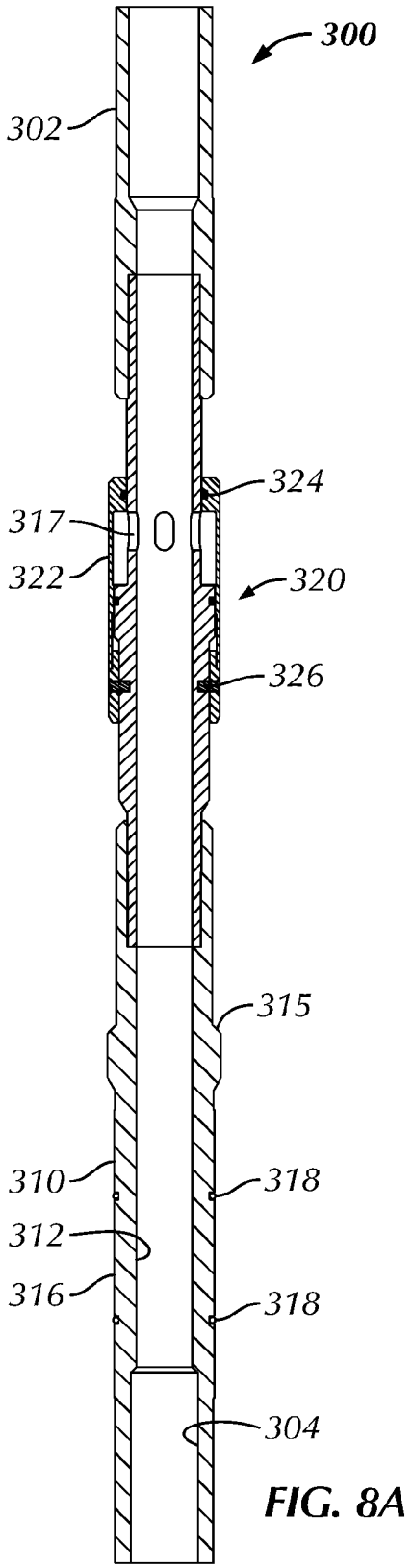
Figure 8B:
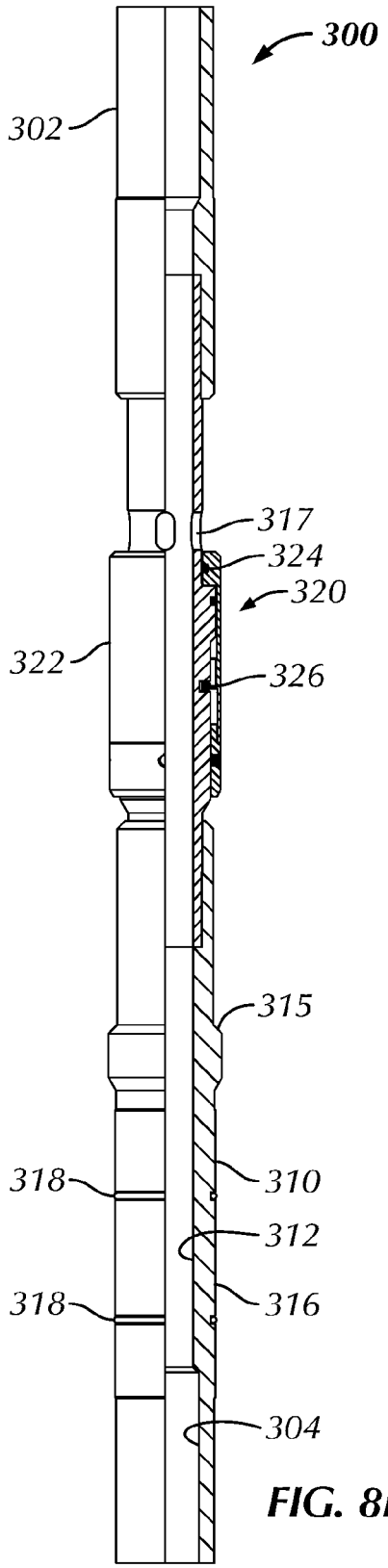

FIGS. 8A-8B illustrate an isolation tool for the washpipe of the gravel pack assembly in FIGS. 5 and 6A-6B in closed and opened conditions.

Figure 8C:
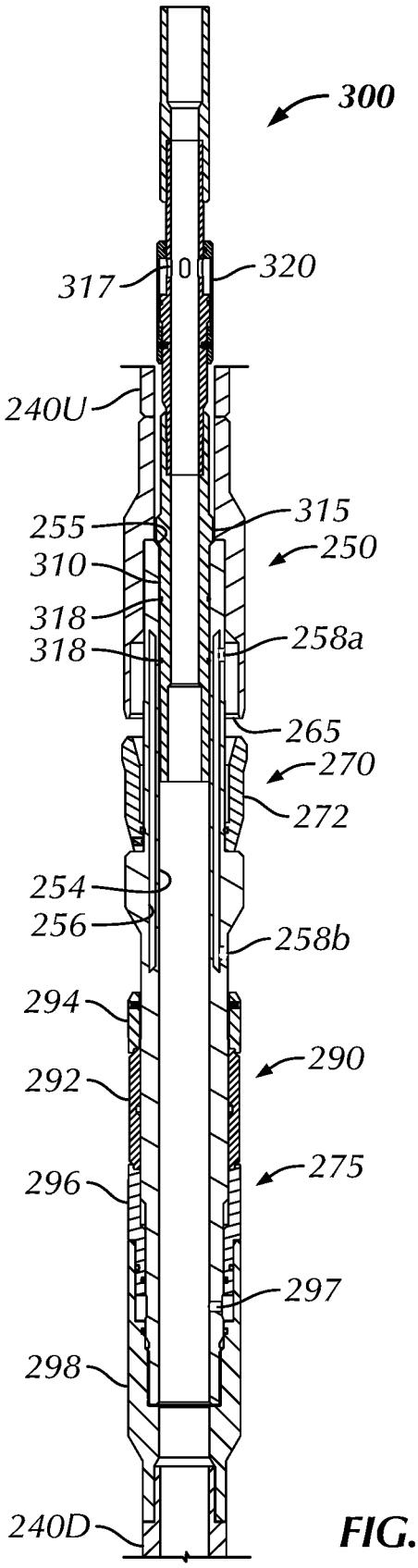

FIG. 8C illustrates the isolation tool disposed in a concentric bypass packer apparatus of the present disclosure.

Figure 9A:
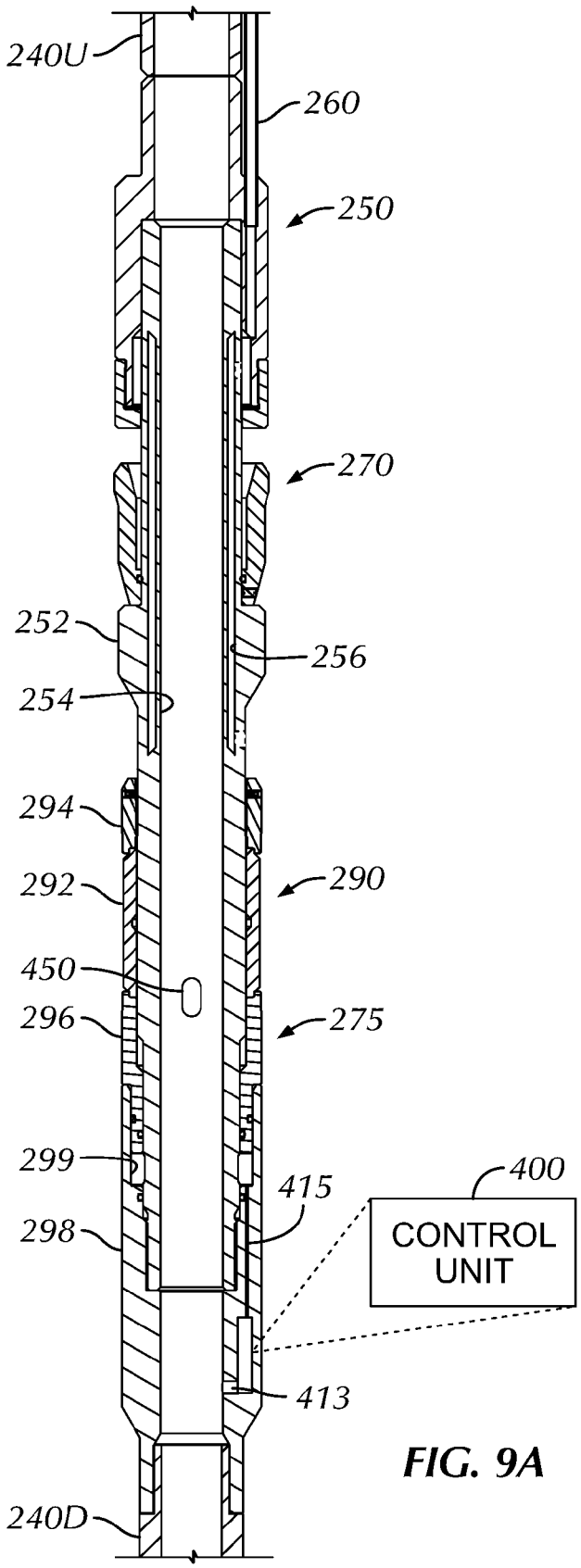

FIG. 9A illustrates an embodiment of a concentric bypass packer apparatus having a transport tube; a concentric bypass; a cup packer; a hydraulically-actuated, compression-set packer; and an electronic control unit for the disclosed gravel pack assembly.

Figure 9B:
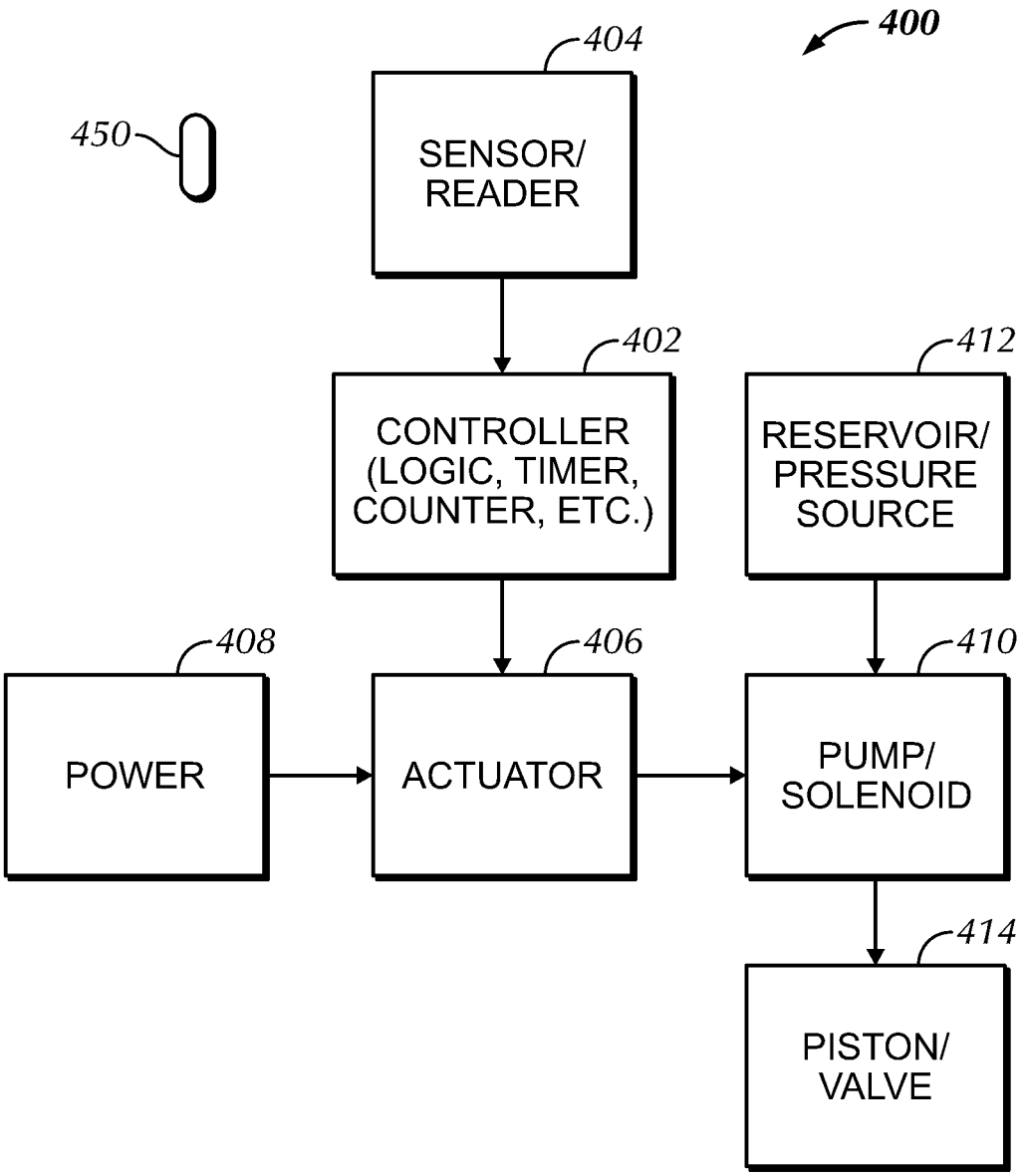

FIG. 9B schematically illustrates details of an electronic control unit for the disclosed packer apparatus.

DETAILED DESCRIPTION OF THE DISCLOSURE

Turning to FIGS. 2 and 3A-3D, a gravel pack assembly 200 according to the present disclosure is disposed in a borehole 10. In general, the borehole 10 can be an open hole as in FIG. 2, or it can be a cased hole as in FIGS. 3A-3D having perforations 18U-D at zones of interest. Although shown as vertical, the borehole 10 can be deviated, depending on the implementation.

Figure 1:
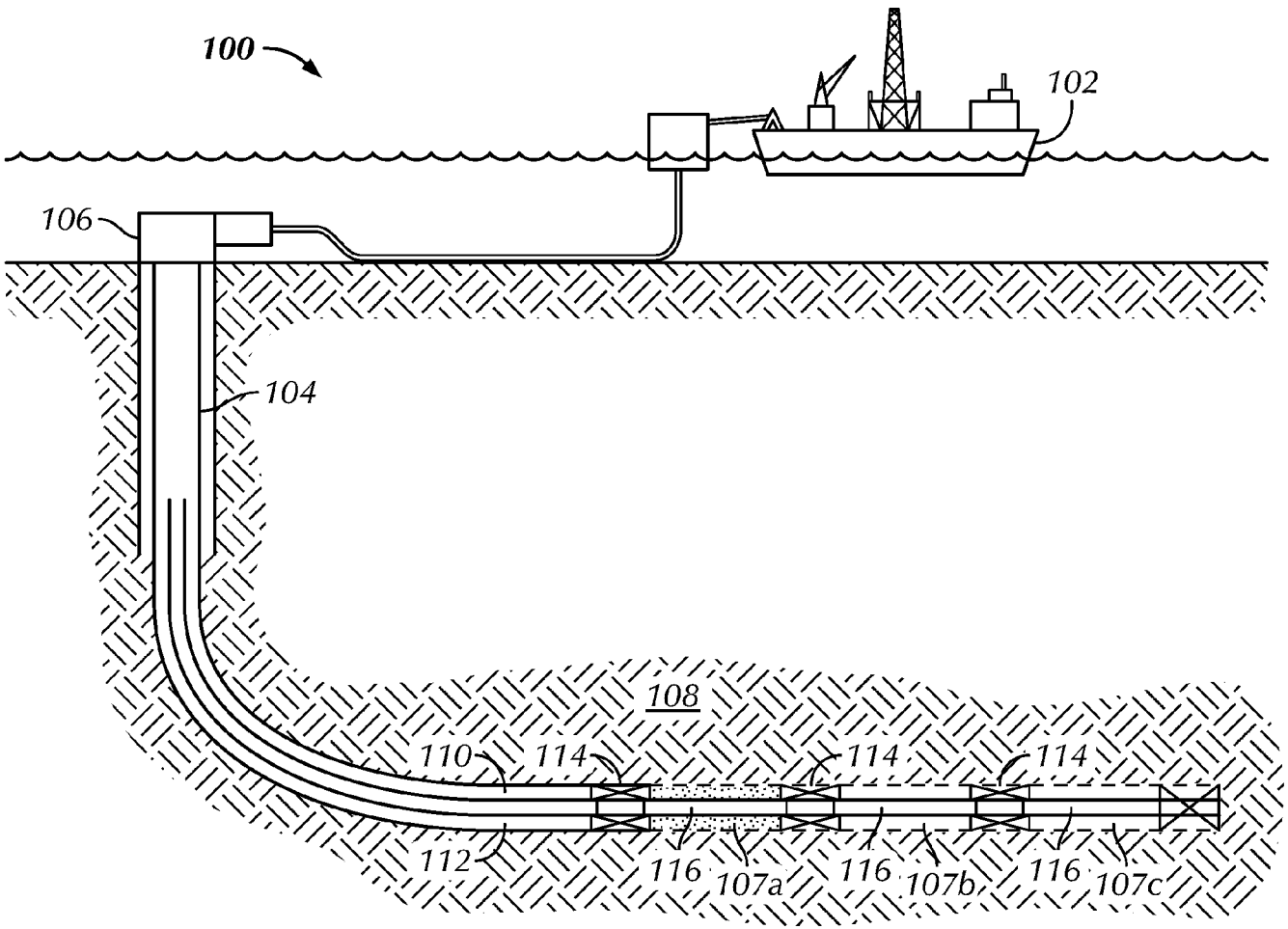
FIG. 1 is a schematic sectional view of a multi-zone production system according to the prior art.
Figure 2:
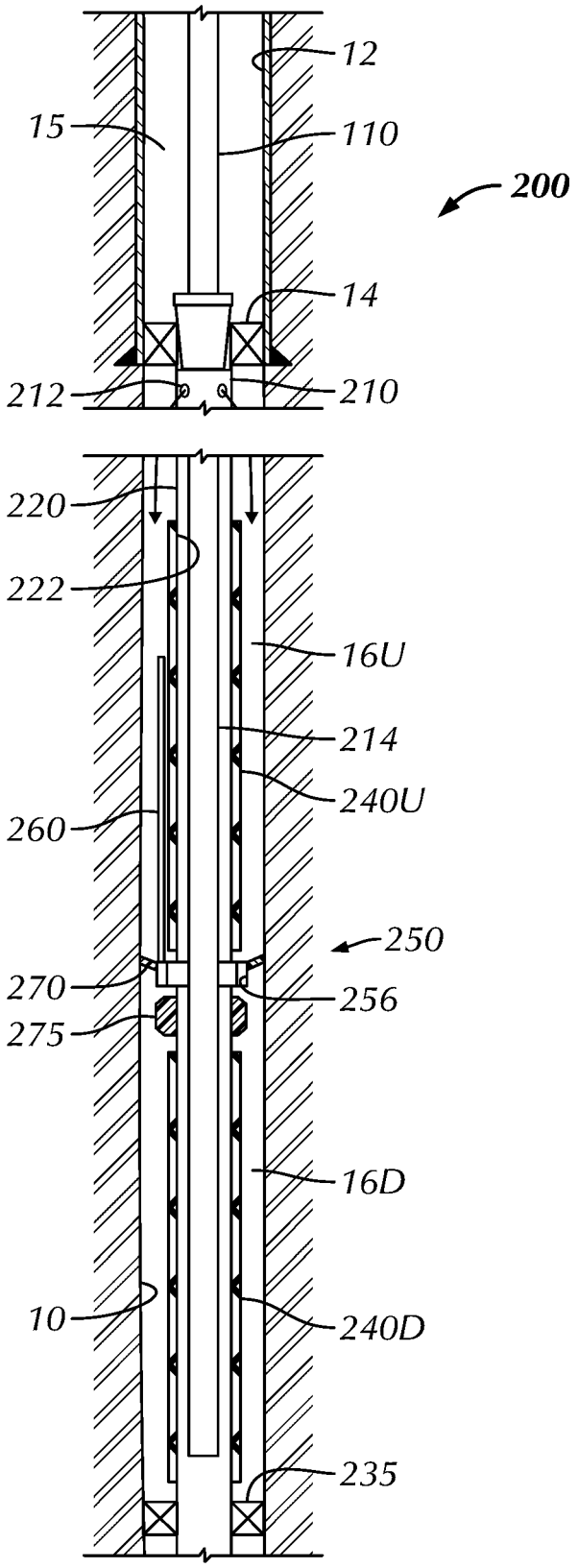
FIG. 2 illustrates a schematic view of a gravel pack assembly according to one embodiment of the present disclosure.

As shown in FIG. 2, the assembly 200 extends downhole from a packer 14 and has a tubular body 220, conduit, liner, or the like, which can comprise one or more components interconnected together. The tubular body 220 and borehole 10 define an annulus 16 about the body 220, and the body 220 defines an internal passage 222 for passage of production fluid, tools, and the like.

Along its length, the body 220 has at least two screen sections 240U-D disposed next to zones of interest in the formation. For a cased hole as in FIGS. 3A-3D, perforations 18U-D in the casing 12 may be provided to communicate the borehole 10 with the zone of interest. Either way, each screen section 240U-D can have one or more screens, which can be any suitable type of screen for gravel pack operations.

During operations, the assembly 200 is disposed in the borehole 10 using known techniques so that the tubular body 220 can eventually be used for production from the various zones. To control sand and other fines, gravel packing operations are performed in the annulus 16 around the tubular body 220 of the assembly 200. To do this, operators install a workstring 110 into the assembly 200 and begin pumping slurry down the annulus 16 around the assembly 200 to gravel pack around the screen sections 240U-D.

As shown in FIG. 2, the work string 110 installs in the packer 14, and a washpipe 214 on the work string 110 extends into the assembly 200 through the screen sections 240U-D. At the packer 14, a cross-over tool 210 diverts a slurry of gravel and carrier fluid conveyed down the workstring 110 out the cross-over's outlet ports 212 and into the annulus 16 around the assembly 200. Meanwhile, fluid returns from the slurry entering the screen sections 240U-D can flow up the washpipe 214 and can pass through the cross-over tool 210 and into the annulus 15 uphole of the packer 14 toward the surface.

The uphole screen section 240U disposed on the body 220 toward an uphole end communicates the uphole annulus 16U of the borehole 10 with the body's interior passage 222. In a similar fashion, the downhole screen section 240D disposed on the body 220 toward a downhole end communicates the downhole annulus 16D of the borehole 10 with the interior passage 222. Any suitable type of screens can be used for the screen section 240U-D and can include wire-wrapped screens, pre-packed screens, direct-wrapped screens, meshes, etc.

Disposed between these two screen sections 240U-D is a concentric bypass packer apparatus 250 according to the present disclosure. In general, any number of screen sections 240 separated by concentric bypass packer apparatus 250 can be disposed along the length of the assembly's body 220. Finally, an isolation packer 235 can be disposed at the downhole end of the assembly 200.

The concentric bypass packer apparatus 250 includes at least two packers 270 and 275 and a concentric bypass 256. One or more transport tubes 260 extend from the concentric bypass 256 along the upper screen section 240U in the upper annulus 16U. As will be discussed below, the transport tube 260 and concentric bypass 256 selectively communicate the uphole annulus 16U with the downhole annulus 16D during stages of a gravel pack operation.

As shown, the at least two packers 270 and 275 on the concentric bypass packer apparatus 250 include a first uphole packer 270 and a second downhole packer 275. The uphole packer 270 restricts passage of at least gravel (and not necessarily fluid) from the uphole annulus 16U to the downhole annulus 16D, although the uphole packer 270 could be used to achieve at least some fluid isolation of the annulus 16. This uphole packer 270 can be a passive type of packer, such as a cup packer, that freely engages the sidewall of the borehole 10 or casing 12.

By contrast, the downhole packer 275 is independently-actuated to engage the sidewall of the borehole 10 or casing 12 and to form a fluid isolation seal between zones. As such, the downhole packer 275 is an active type of packer that deploys unexpanded into the borehole 10 and is later activated to engage the borehole or casing wall as detailed below. Once activated, the downhole packer 275 isolates fluid passage between the uphole and downhole annuli 16U-D to isolate the two zones.

This second packer 275 can have a swellable packer element. In some applications, however, a swellable packer element may not be the best choice because the time required to achieve sufficient swelling can be hard to manage. In particular, the swelling needs to be timed to ensure that enough space remains in the annulus around the swellable packer element when pumping gravel pack slurry downhole before the element actually swells and creates a seal with the borehole or casing wall.

For this reason, the second packer 275 is preferably independently compressible and can use a compression-set packing element that is mechanically, hydrostatically, hydraulically, and/or electronically activated. The compressive force used to activate the downhole packer 275 can be delivered through hydrostatic pressure, hydraulic (applied) pressure, or mechanical action. As the compressive force is delivered to the downhole packer 275, its compressible element is compressed in length and expands radially until contacting the wellbore 10 or casing 12 to create a seal between the packer apparatus 250 and the wellbore 10 or casing 12.

As noted above, the concentric bypass packer apparatus 250 also includes the bypass 256 between the two annuli 16U-D. As shown, an uphole end of the concentric bypass 256 communicates with at least one transport tube 260, and a downhole end of the concentric bypass 256 communicates with the downhole annulus 16D. As noted above, the transport tubes 260 are used as shunt tubes and are not attached to packing tubes carrying gravel. Thus, multiple stages can be set up with each lower stage having transport tubes 260 open at the distal ends with the intent of taking diverted slurry and delivering it to the next lower zone as that upper zone is filled. Finally, the screen section 240D below the packer apparatus 250 may or may not be equipped with transport tubes (not shown).

Figure 3A:
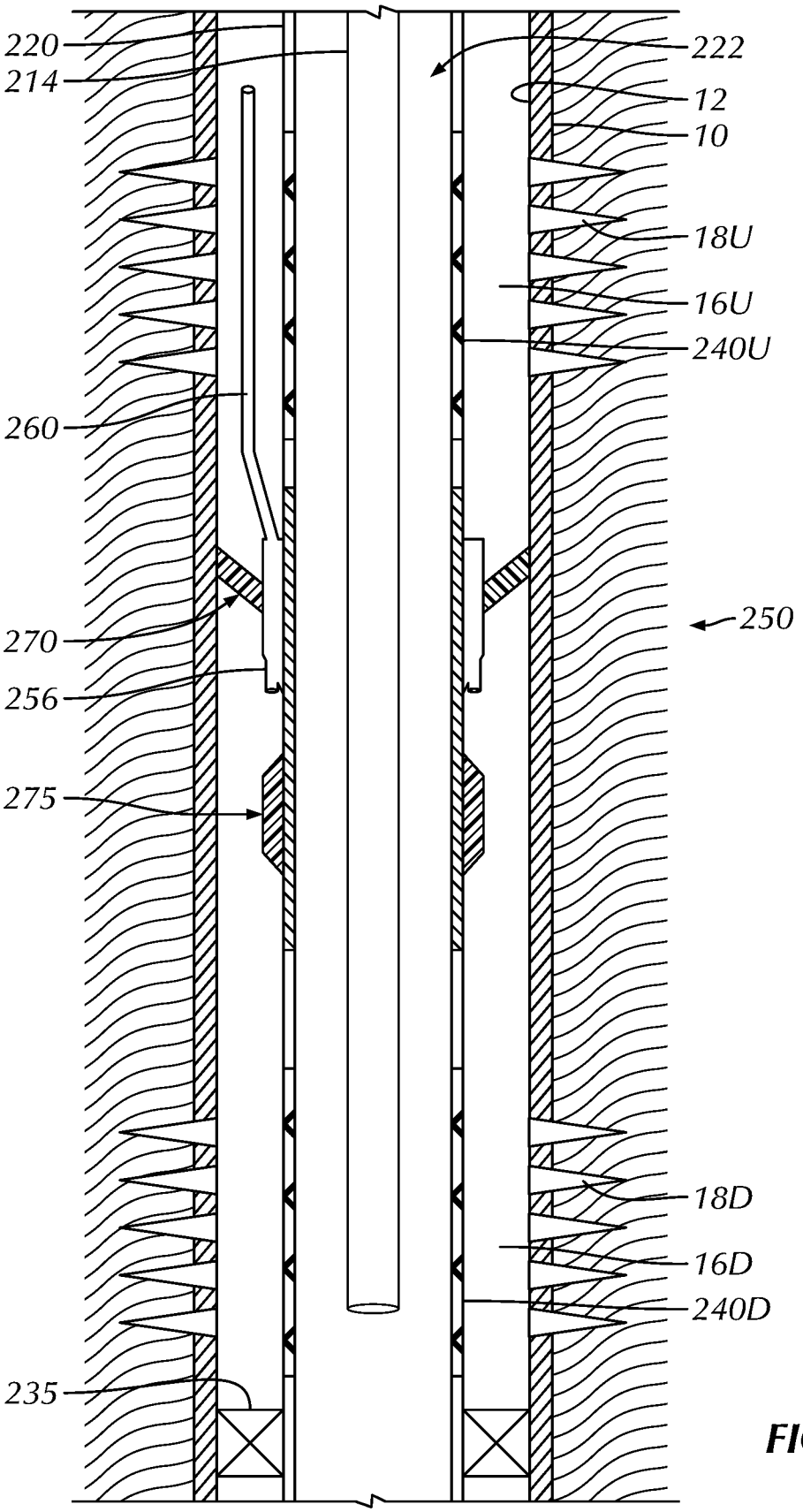
FIGS. 3A-3D illustrate portions of the gravel pack assembly in FIG. 2 during stages of a gravel pack operation.

Turning to more details of the assembly 200, FIGS. 3A-3D illustrate portions of the gravel pack assembly 200 in FIG. 2 during stages of a gravel pack operation. As shown in FIG. 3A at the start of the gravel pack operation, the downhole packer 275 is run downhole in an unactivated state. Meanwhile, the uphole packer 270, such as a cup packer, is adapted to passively engage the surrounding borehole 10 or casing 12 to at least partially seal the uphole annulus 16U from the downhole annulus 16D.

Figure 3B:
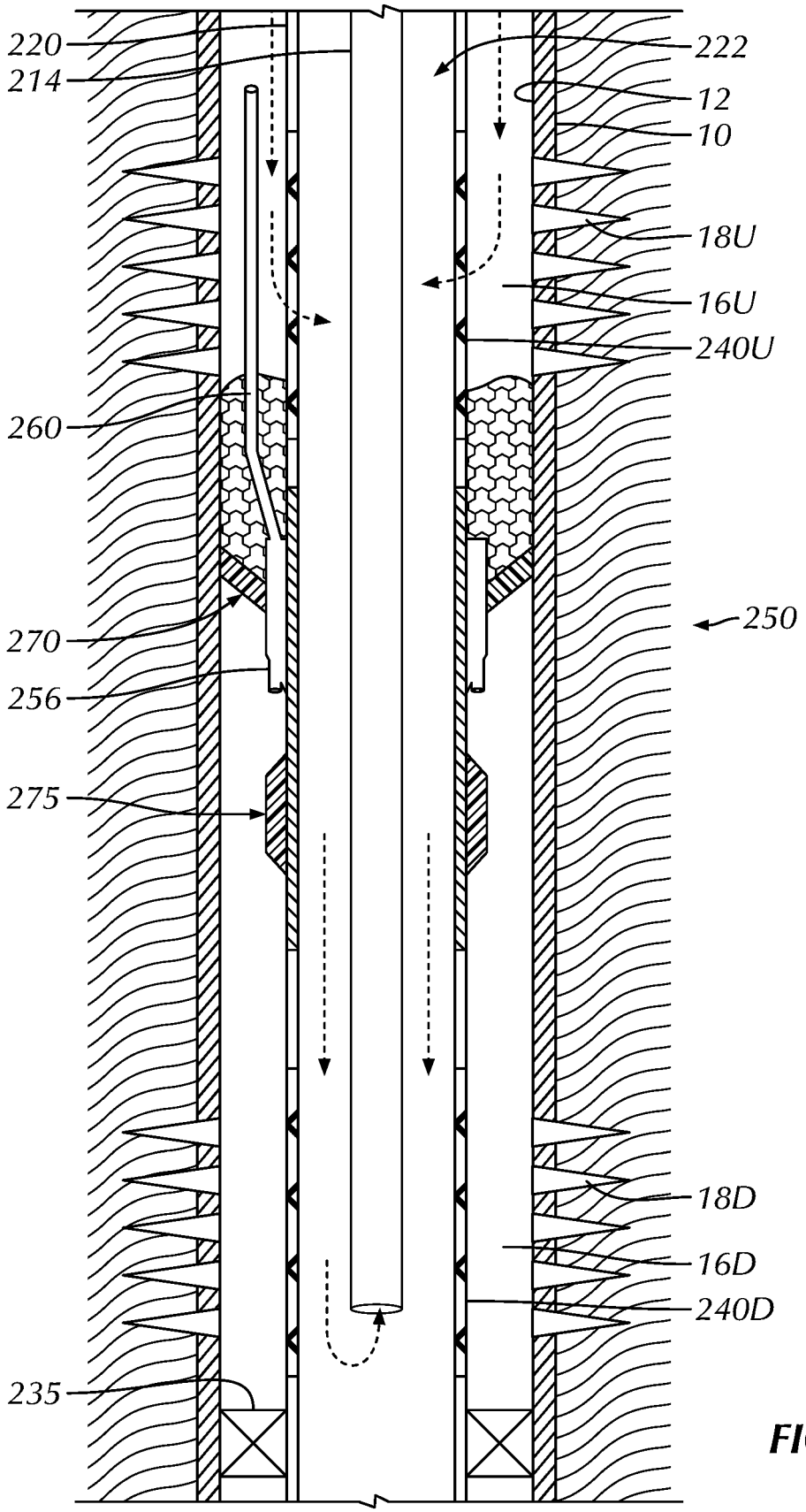

Gravel packing can then be started by communicating slurry having carrier fluid and gravel down the uphole annulus 16U using conventional techniques, such as the cross-over tool discussed above. As shown in FIG. 3B, gravel packing begins as the slurry of gravel and carrier fluid passes out of the cross-over tool (210: FIG. 2) and into the uphole annulus 16U. Gravel from the slurry begins to pack around the upper screen section 240U, being checked from passing to the downhole annulus 16D by the uphole packer 270. The carrier fluid in the slurry enters the uphole screen section 240U, and the remaining gravel deposits in the annulus 16U around the upper screen section 240U. Once the carrier fluid enters the assembly's body 220, the fluid is circulated up the washpipe 214 disposed in the interior passage 222 of the assembly 200.

Figure 3C:
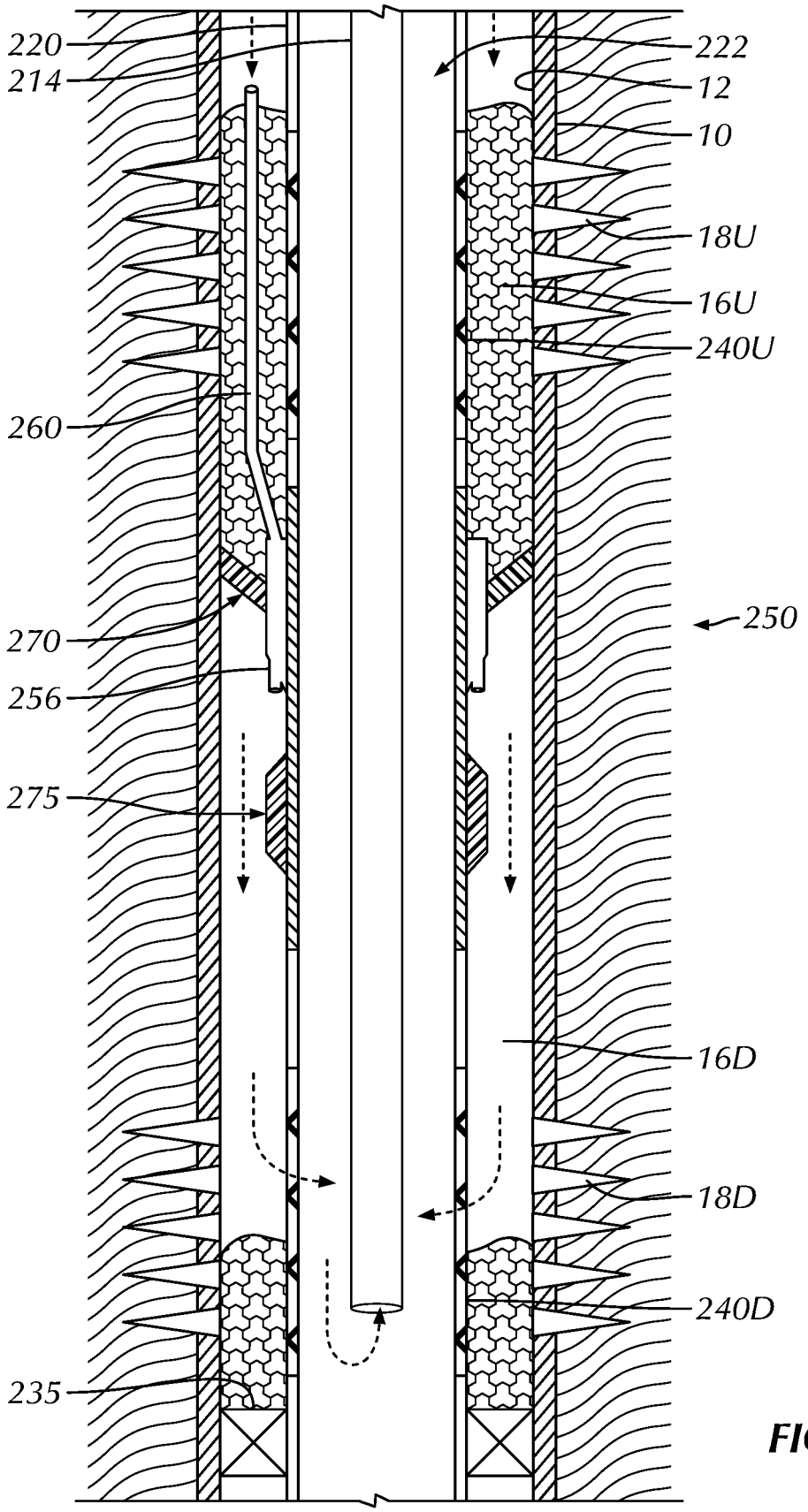

Once the upper screen section 240U is covered with gravel as shown in FIG. 3C, the slurry in the uphole annulus 16U diverts into the one or more transport tubes 260. At this point, the slurry flows through the tubes 260 to the concentric bypass 256 inside the packer apparatus 250. Leaving the concentric bypass 256, the slurry then begins to pack gravel around the downhole screen section 240D. Returns of the carrier fluid passing through the downhole screen section 240D also pass up the washpipe 214.

During gravel packing, a pressure drop can be created through the concentric bypass 256. The resulting back pressure on the upper annulus 16U could result in fluid loss to the formation (i.e., through perforations 18U), which can end the pumping operation prior to placing sufficient gravel in downhole annulus 16D and across perforations 18D. By installing the one or more transport tubes 260 along the upper screen section 240U and across the upper perforations 18U, however, the slurry can have a direct route to the lower annulus 16D. In this way, gravel packing the downhole annulus 16D is not dependent on keeping the upper annulus 16U open for flow.

As shown, the one or more transport tubes 260 preferably do not include nozzles for distributing the slurry in the uphole annulus 16U and preferably do not connect to a shunt tube or the like. Instead, the distal ends of the one or more transport tubes 260 are disposed freely inside the uphole annulus 16U. In fact, the distal ends may preferably extend to a point uphole of the uphole screen section 240U to receive slurry during the gravel pack process after the uphole screen section 240U is packed. The orifices at the distal ends of the tubes 260 can be modified to facilitate entry of the slurry if necessary.

Additionally, instead of passing the transport tubes 260 through the element of the uphole packer 270, the packer apparatus 250 preferably has the uphole packer 270 disposed about an outer housing, body, mandrel, or the like disposed concentrically about an inner housing, body, mandrel, or the like of the packer apparatus 250. One or more outlets of such an outer mandrel can communicate with the downhole annulus 16D. Thus, once the downhole packer 275 is activated as detailed below, the downhole packer 275 closes off communication of the transport tubes 260 and concentric bypass 256.

Figure 3D:
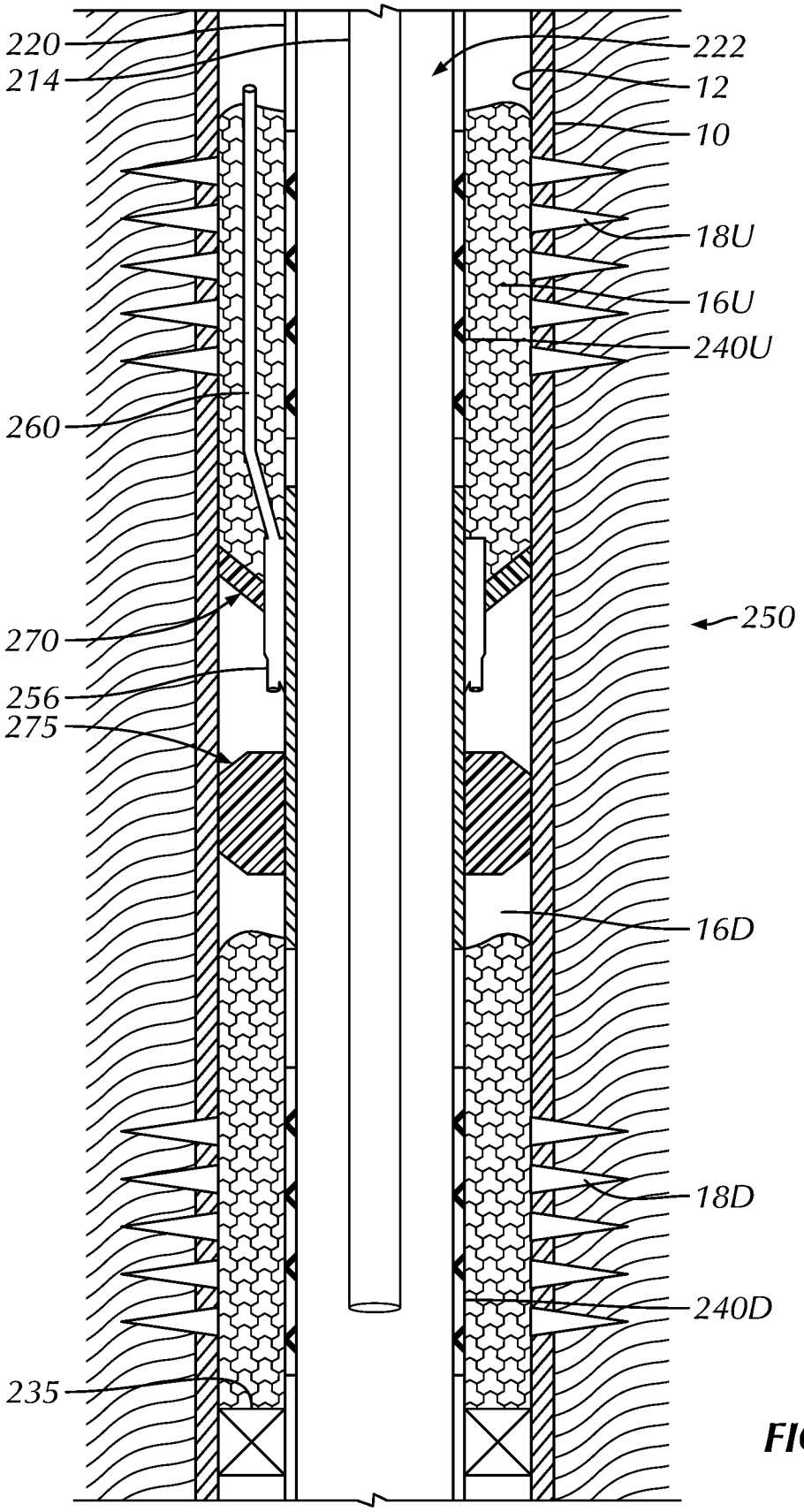

As finally shown in FIG. 3D, slurry flow is stopped once the downhole screen section 240D is covered with gravel. The annulus 16D immediately below the bypass packer apparatus 250 will be free of gravel, which has tended to gravitate and pack around the downhole screen section 240D. In particular, as the circulation of slurry stops, a section of the wellbore between the uphole packer 270 and the lower well screen section 240D will be free of gravel. It is in this area that the downhole packer 275 of the bypass packer apparatus 250 can then be expanded to seal inside the borehole 10 or casing 12 and isolate the two zones. Sealing of the downhole packer 275 closes off any fluid communication between the uphole annulus 16U and the downhole annulus 16D via the concentric bypass 256 and transport tubes 260.

As noted previously, the second downhole packer 275 can include different types of packer elements. For example, this downhole packer 275 may be a swellable packer. For those instances where a swelling elastomer is not a good choice, the packing element of the downhole packer 275 as noted previously can be a compressible packing element that is actuated mechanically, hydrostatically (with hydrostatic pressure), and/or hydraulically (with applied pressure). In other alternatives, the downhole packer 275 can be electronically actuated by using electronic receivers to start a motor, operate a pump, open a valve, or cause a delivery of force to set a compressible packing element once a signal is sent to the receiver. These alternatives will be discussed herein below.

Figure 4A:
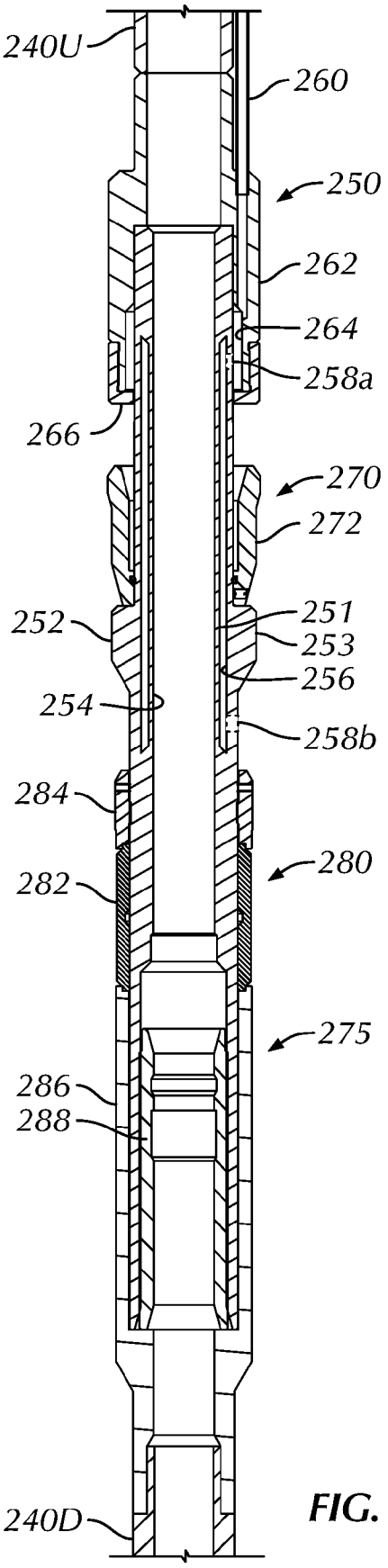
FIG. 4A illustrates an embodiment of a concentric bypass packer apparatus having a transport tube; a concentric bypass; a cup packer; and a mechanically-actuated, compression-set packer for the disclosed gravel pack assembly.

In one embodiment shown in FIG. 4A, the concentric packer apparatus 250 has one or more transport tubes 260; a concentric bypass 256; an upper packer 270 having a cup packer 272; and a downhole packer 275 having a mechanically-actuated, compression packer 280. As before, the packer apparatus 250 allows for gravel packing multiple zones in a single pumping operation. The uphole packer 270 serves as a foundation supporting the gravel pack for the upper annulus. Thus, the uphole packer 270 serves as a base on which gravel pack sand can settle once circulation through the concentric bypass 256 stops due to a downhole screen (240D) below the cup packer 272 becoming covered with gravel pack sand. Although the uphole packer 270 is shown as a cup packer 272, the uphole packer 270 can be a mechanically-actuated packer, a hydraulically-actuated packer, or other type of packer actuated by other means to stop at least the flow of gravel in the annulus outside the apparatus 250 and to force slurry through the bypass 256 of the packer apparatus 250.

Here, the mechanically-actuated, compression-set packer 280 has a compressible packing element 282 disposed between end-rings 284 and 286. When activated mechanically, the downhole packer 280 serves to isolate the upper annulus (16U) from the downhole annulus (16D) after the gravel packing operation so the packer 280 can stop the flow of fluids and gravel in the annulus outside the packer apparatus 250 to isolate the wellbore's zones. As before, the packing element 282 can remain unset (unexpanded) until after the gravel pack is performed.

Looking at the bypass packer apparatus 250 in detail, a housing or mandrel 252 of the packer apparatus 250 defines an internal bore 254 therethrough. An uphole end of the mandrel 252 has a manifold 262 disposed thereon, which couples in a conventional manner to the upper zone screen section (240U). A downhole end of the mandrel 252 couples in a conventional manner to the lower zone screen section (240D). The concentric bypass 256 is configured through the mandrel 252 to bypass the uphole packer 270 and to convey slurry from the transport tubes 260 above the uphole packer 270 to an outside space below the uphole packer 270.

In particular, the transport tubes 260 on the upper zone screen section (240U) extend to the manifold 262 on the top of the packer's mandrel 252. The connection of the manifold 262 on the packer's mandrel 252 can allow the manifold 262 and associated transport tube 260 to be swiveled around the central mandrel 252, allowing for easier attachment to the transport tubes 260 on well screens and other components during assembly. This can eliminate the need for costly connections, e.g., timed threads, to make up the disclosed packer apparatus 250 to a screen joint and have the transport connections aligned.

The manifold 262 defines an annular space 264 around the end of the mandrel 262, which is closed off by a cap ring 266. One or more upper ports 258*a* in the mandrel 252 communicate the bypass 256 with the manifold's space 264. Downhole of the cup packer 270, the mandrel 252 defines one or more downhole ports 258*b* for communicating the bypass 256 outside the mandrel 252.

Although not specifically shown in detail, it will be appreciated that the mandrel or housing 252 of the packer apparatus 250 can be comprised of multiple components, such as inner and outer mandrels with the concentric bypass 256 formed between them. Thus, as represented in FIG. 4A, the packer apparatus 250 preferably has the uphole packer 270 disposed about an outer mandrel 253, which is disposed concentrically about an inner mandrel 251 of the apparatus 250. In this way, the outer mandrel 253 can form the internal concentric bypass 256 with the inner mandrel 251. Additionally, the inner mandrel 251 can have the internal bore 254, and the outer mandrel 256 can have the uphole and downhole external ports 258*a-b*. These and other details will be evident to one skilled in the art having the benefit of the present disclosure.

During operations as disclosed herein after then upper screen section 240U is packed, slurry travels through the transport tubes 260 and into the manifold's space 264. Passing through the upper ports 258*a*, the slurry enters the concentric bypass 256 and bypasses the cup packer 270. The slurry then exits the concentric bypass 256 below the cup packer 270 through the lower ports 258*b* defined above the compression-set packer 280. The slurry flows around the compression-set packer 280 and into the annulus (16D) around the lower screen section 240D when gravel packing is completed.

As noted previously, the downhole packer 275 in the present example is the mechanically-actuated, compression-set packer 280, which stops the flow of fluids in the annulus. The packer 280 has a compressible packing element 282 disposed between end rings 284 and 286. An inner sleeve 288 disposed in the packer's bore 254 can be mechanically shifted using a shifting tool, wireline, coil tubing, or other appropriate technique to compress the compressible element 282 between the end rings 284 and 286.

In one embodiment, for example, the compressible packing element 282 is expanded by using a shifting tool (not shown) made up on a string of pipe (i.e., washpipe 214) run inside the screen sections 240U-D as part of the gravel pack assembly. The shifting tool engages the inner mandrel 288 of the downhole packer 280 using keys, collet, or the like and force is delivered though this mandrel 288 into the packer element 288, causing the radial expansion. Alternatively, the compressible element's setting force can be delivered on a separate trip in the well for the purpose of expanding the element 288 using a pipe, a wireline, or a shifting tool made up on pipe stung though the gravel pack assembly. These and other procedures can be used to set the downhole packer 280 during gravel pack operations.

Regardless of how the sleeve 288 is mechanically moved, the sleeve 288 can connected by transmission rods, lugs, or the like (not shown) to external components of one of the end rings 284 and 286 to compress the packing element 282. Lock rings and the like (not shown) can be used to lock the inner sleeve 288 in an upper position once shifted so as to maintain the packing element compressed.

As noted herein, transport of the slurry from the transport tubes 260 and the bypass 256 does not pass underneath the downhole packer 280. Thus, radial expansion of the compressible packing element 282 is not hindered because the element 282 is disposed about the outside of the packer apparatus 250. Moreover, the packing element 282 can have a greater mass of sealing material and can have more uniform element expansion and less complicated pack-off mechanism.

Figure 4B:
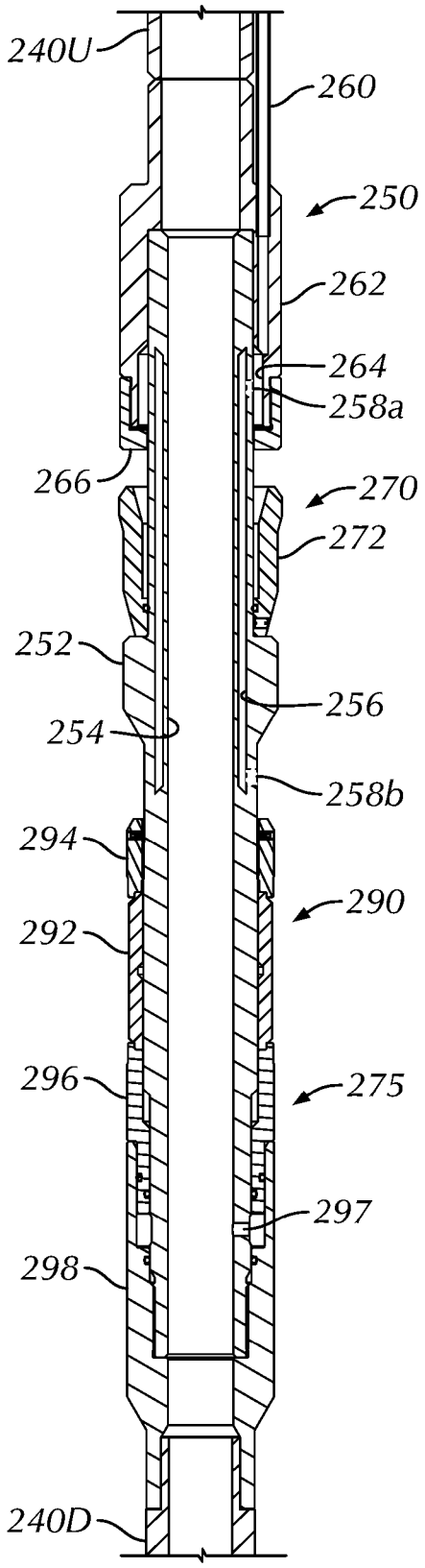
FIG. 4B illustrates an embodiment of a concentric bypass packer apparatus having a transport tube; a concentric bypass; a cup packer; and a hydraulically-actuated, compression-set packer for the disclosed gravel pack assembly.

In another embodiment shown in FIG. 4B, the concentric bypass packer apparatus 250 has a transport tube 260; a concentric bypass 256; an uphole packer 270 having a cup element 272; and a downhole packer 275 having a hydraulically-actuated, compression-set packer 290. Many features of this bypass packer apparatus 250 are similar to those disclosed above with reference to FIG. 4A so that like reference numerals are used for similar components. Additionally, use of the packer apparatus 250 is similar to the steps outlined previously.

Overall, the uphole cup packer 272 serves as a base on which gravel pack sand can settle once circulation through the concentric bypass 256 stops due to the downhole screen section 240D below the cup packer 272 becoming covered with gravel pack sand. Additionally, the hydraulically-actuated, compression-set packer 290 serves to isolate the upper annulus (16U) from the downhole annulus (16D) after the gravel packing operation so that this packer 290 can remain unset (unexpanded) until after the gravel pack is performed.

The hydraulically-actuated, compression-set packer 290 has a compressible packing element 292 disposed between an end ring 294 and a hydraulic piston 296. Fluid pressure communicated through an internal port 297 of the bypass packer's bore 254 forces the piston 296 against the element 292 and compresses it against the end ring 294. Shear pins and the like (not shown) can be provided so that the hydraulic piston 296 does not move until a particular pressure level is reached. Additionally, lock rings and the like (not shown) can be provided to keep the piston 296 set once activated.

In one embodiment, the hydraulically-actuated packer 290 is set by using fluid pressure supplied to the internal port 296 via the gravel pack assembly or via an internal string of pipe (i.e., washpipe 214 or other tool) run inside the gravel pack assembly. Such a tool can deliver the fluid pressure when desired in the course of operations to set the element 292 against the wellbore or casing. In an alternative or in addition to the applied pressure, the downhole packer can use hydrostatic pressure in the wellbore against a hydrostatic chamber (not shown) in conjunction with a piston 296 to compress the compressible packing element 292.

Figure 4C:
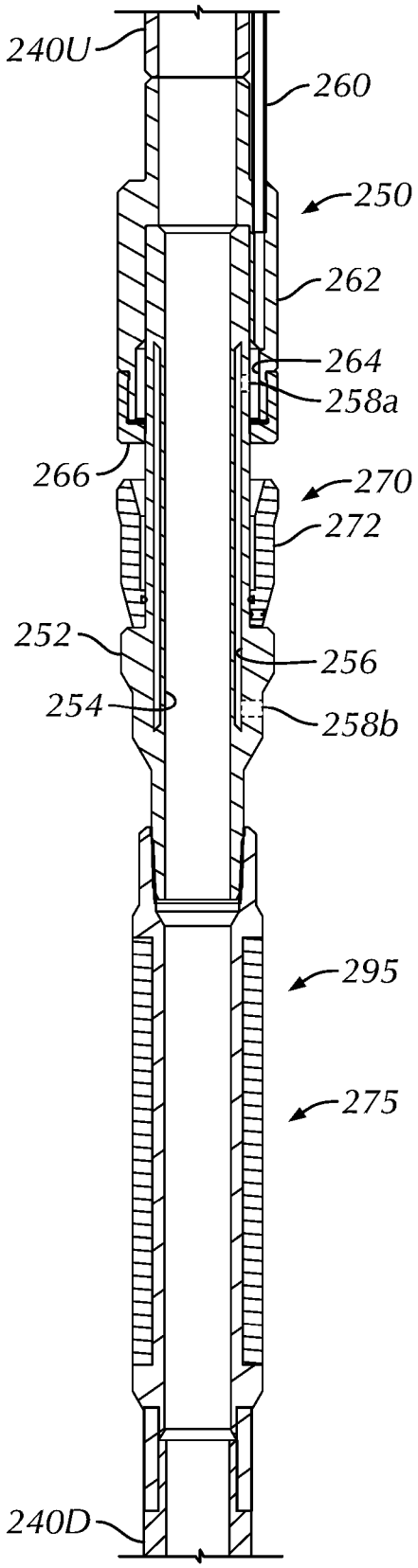
FIG. 4C illustrates an embodiment of a concentric bypass packer apparatus having a transport tube, a concentric bypass, a cup packer, and a swellable packer for the disclosed gravel pack assembly.

Finally, as noted above, the downhole packer 275 on the bypass packer apparatus 250 can also be a swellable packer if suitable for the implementation. Turning to FIG. 4C then, an embodiment of a concentric bypass packer apparatus 250 having a transport tube 260, a concentric bypass 256, an uphole packer 270 with a cup element 272, and a downhole packer 275 having a swellable packer element 295 for the gravel pack assembly is shown in cross-section. The swellable packer element 295 can be configured to swell in response to various conditions. Additionally, the swellable packer element 295 can use features disclosed in incorporated US2013/0161000 to accommodate a volume of gravel displaced by the swellable packer 295 in the wellbore annulus.

FIG. 5 illustrates a gravel pack assembly 200 according to another embodiment of the present disclosure. Rather than gravel packing the upper annulus 16U before the downhole annulus 16D as in FIGS. 2 and 3A-3D, gravel packing in this assembly 200 packs the downhole annulus 16D and then the uphole annulus 16U. As such, the concentric bypass packer apparatus 250 does not require transport tubes as used in previous embodiments.

As before, the concentric bypass packer apparatus 250 disposed between the two screen sections 240U-D includes at least two packers 270 and 275 and a concentric bypass 256. The first uphole packer 270 restricts passage of at least gravel (and not necessarily fluid) from the uphole annulus 16U to the downhole annulus 16D, although the uphole packer 270 could be used to achieve at least some fluid isolation of the annulus 16. This uphole packer 270 can be a passive type of packer, such as a cup packer 272 shown, that freely engages the sidewall of the borehole 10 or casing 12.

By contrast, the second downhole packer 275 is independently-actuated to engage the sidewall of the borehole 10 or casing 12. As such, the downhole packer 275 is an active type of packer that deploys unexpanded into the borehole 10 and is later activated to engage the borehole or casing wall as detailed below. Once activated, the downhole packer 275 isolates fluid passage between the uphole and downhole annuli 16U-D to isolate the two zones.

As shown in FIG. 6A, the downhole packer 275 is run downhole in an unactivated state. Meanwhile, the uphole packer 270, such as the cup packer 272 shown, is adapted to passively engage the surrounding borehole 10 or casing 12 to seal at least gravel passage from the uphole annulus 16U to the downhole annulus 16D.

A gravel pack operation begins by running the washpipe 214 down the assembly 220, and a tool 300 on the washpipe 214 seals inside the packer apparatus 250. In particular, a stinger 310 of the tool 300 seals inside the bypass packer apparatus 250, while a valve 320 of the tool 300 remains closed. Slurry is communicated down the annulus 16 around the assembly 220 from the cross-over tool (212: FIG. 5) uphole. Because fluid communication up the washpipe 214 is isolated from the uphole screen section 240U by the closed valve 320 and by the stinger 310 sealed inside the bypass packer apparatus 250, the slurry enters the concentric bypass 256 from the uphole annulus 16U and begins to pack around the lower screen section 240D.

The carrier fluid in the slurry enters the downhole screen section 240D so that gravel deposits in the downhole annulus 16D around the lower screen section 240D. Once the carrier fluid enters the assembly's body 220, the fluid is circulated up the washpipe 214 disposed in the inner passage 222 of the assembly 200.

Once the lower screen section 240D is covered as shown in FIG. 6B, the slurry flow through the concentric bypass 256 wanes and ceases. In particular, flow of slurry becomes more limited as the gravel packs around the lower screen section 240D and less carrier fluid can flow through the lower screen section 240D. Therefore, pressure builds, and the valve 320 on the washpipe tool 300 opens so that fluid returns can enter the washpipe 214 from the upper screen section 240U instead.

With the valve 320 open, the slurry communicated down the uphole annulus 16U and checked from passing to the downhole annulus 16D by the uphole packer 270 begins to pack around the upper screen section 240U. Fluid returns can enter the washpipe 214 from the upper screen section 240U through the open valve 320 on the washpipe tool 300.

As with the other embodiments of the present disclosure, the bypass packer apparatus 250 for the system 200 in FIGS. 5 and 6A-6B can use any of the various types of packing elements for the downhole packer 275. For example, FIG. 7A illustrates an embodiment of the concentric bypass packer apparatus 250 having a mechanically-actuated compression-set packer 280 as the downhole packer 275; and FIG. 7B illustrates an embodiment of the concentric packer apparatus 250 having a hydraulically-actuated, compression-set packer 290 for the downhole packer 275. Finally, FIG. 7C illustrates an embodiment of the bypass packer apparatus 250 having a swellable packer element 295 as the downhole packer 275.

Many of the components of the packer apparatus 250 in FIGS. 7A-7C are similar to those described above with reference to FIGS. 4A-4C so that like reference numerals are used for similar components. Therefore, these elements are not described again. However, because the assembly 200 of FIGS. 5 and 6A-6B gravel packs the downhole annulus 16D first, each of these bypass packers 250 lacks a transport tube as in previous embodiments. Instead and as preferably shown, the upper port 258*a* of the concentric bypass 256 on the packers 250 has a hood 265, down-hole facing passage, or other feature for creating a tortious path for the flow of slurry. Thus, slurry collecting on the upper cup packer 272 during gravel packing must follow along the tortious path into the hood 265 and then into the upper port 258 before entering the bypass 256. Once the downhole section (240D) is packed off, such a tortious path can help the upper section (240U) begin to fill with gravel.

Because the assembly 200 of FIGS. 5 and 6A-6B gravel packs the downhole annulus 16D first, a means for controlling fluid flow in the washpipe 214 is needed. To that end, the system 200 uses the washpipe tool 300 for the washpipe 214 that disposes inside the concentric packer apparatus 250 as discussed previously. FIGS. 8A-8B illustrate an embodiment of a washpipe tool 300 for the washpipe (214) in closed and opened conditions, and FIG. 8C illustrates the washpipe tool 300 disposed in a concentric bypass packer apparatus 250 of the present disclosure.

The washpipe tool 300 is equipped with a sealing stinger 310 connecting with a connector 302 to an uphole washpipe section (214: FIG. 5). The other end of the stinger 310 has a coupling 304 for connecting to a downhole washpipe section (not shown) so that the internal bore 312 of the stinger 310 acts as a section of the washpipe (214). The stinger 310 has the pressure differential valve 320 uphole of an engagement shoulder 315 on the outside of the stinger 310. Downhole of the shoulder 315, the stinger 310 has a polished surface 316 with an arrangement of seals 318.

The tool 300 prevents the fluid component of the slurry from diverting into the upper screen section (240U: FIG. 5) and flowing instead inside the annulus of the screen section (240U) and washpipe 214 during operations. As would be expected, loss of carrier fluid to the upper screen section (240U) would prematurely dehydrate the slurry across the upper screen section (240U), resulting in an incomplete gravel pack across the lower screen section (240D: FIG. 5).

During gravel pack operations, the washpipe 214 is run in until the engagement shoulder 315 engages an internal shoulder 255 inside the packer apparatus 250, as best shown in FIG. 8C. The seals 318 along the polished surface 316 of the stinger 310 seal inside the packer's internal bore 254. Slurry in the uphole annulus (16U: FIG. 5) uphole of the packer 250 passes through the concentric packer apparatus 250 and fills the downhole annulus (16D: FIG. 5) as described above. Fluid returns passing through the lower screen section (240D) can flow up the washpipe (214) and through the stinger 310 to the crossover tool (210: FIG. 5).

All the while, fluid entry into the upper screen section (240U) is essentially blocked by the sealed tool 300 inside the packer apparatus 250. Consequently, the hydrated sand slurry is forced to flow through the bypass 256 in the upper part of the concentric packer apparatus 250, underneath the cup packer 272, and into the annulus around the lower screen section (240D) so the fluid returns can be taken up by the washpipe and tool 300. The chance of successfully covering the lower screen section (240D) with sand is increased.

Once the lower screen section (240D) is covered, a pressure increase occurs, which opens the pressure differential valve 320 installed on the tool 300 inside the upper screen section (240U). In particular, the valve 320 includes a housing 322 sealed with seals 324 on the tool. Shear pins 326 secure the housing 322 closed over the tool's ports 317. Pressure buildup outside the valve's housing 322 relative to inside the tool 300 eventually breaks the shear pins 326. The housing 322 then shifts away from the port 317, allowing for fluid communication therethrough.

Once the valve 320 opens, fluid returns from the sand slurry can flow through the upper screen section (240U), through the open differential valve 320, into the stinger 310 via ports 317, and eventually up the uphole washpipe section (not shown). This allows the gravel pack sand to dehydrate around the upper screen section (240U).

As noted above, the packer apparatus 250 of the present disclosure can be used for cased or open holes. For cased holes, the upper packer 270 can be a cup packer 272 to form a friction seal with the surrounding casing wall. The packer apparatus 250 can be adapted for open hole applications by making the upper packer 270 hydraulically or hydrostatically-actuated with a compressible packing element that expands enough to seal on the irregularities of an open hole. This arrangement could also be used in cased hole. Finally, the second packer 275 can be a swellable packer, but is more preferably a compression-set packer that is mechanically-actuated, hydraulically-actuated, and/or hydrostatically-actuated packer. However, either one or both of these first and second packers 270 and 275 can be electronically-actuated through the use of radio-frequency identification (RFID) tags, pressure pulse signals, or other detected activation.

As one example, FIG. 9A shows an embodiment of a concentric bypass packer apparatus 250 having a downhole packer 275 that is compression-set and electronically-actuated. The packer apparatus 250 in this example includes a transport tube 260 as with the embodiments of FIGS. 4A-4C, but it could lack such a transport tube comparable to other embodiments disclosed herein if used with a washpipe tool (300) as above. The packer apparatus 250 includes many of the same components as before so that like reference numerals are used for similar components.

In contrast to previous embodiments, the packer apparatus 250 has a control unit 400 for controlling operation of the packer apparatus 250. During operation, gravel packing can occur as before in FIGS. 2 and 3A-3D with slurry first collecting in an upper screen section 240U and then passing through the transport tube 260 and the concentric bypass 256 to pack around the downhole screen section 240D. (Alternatively, without the transport tube 260, gravel packing can occur as before in FIGS. 5 and 6A-6B with slurry first collecting in the lower screen section 240D and then packing around the upper screen section 240D.) All the while, fluid returns can pass up through a washpipe in the internal bore 254 of the packer apparatus 250.

In any event, in addition to the passive pack off provided by the upper packer 270, operations will activate the isolation provided by the downhole packer 275 of the apparatus 250 to close the uphole and downhole screen sections 240U-D. Here, the downhole packer 275 has a hydraulically-actuated, compression-set packer 290 as described previously with reference to FIGS. 4B, but any of the other independently compressible arrangements can be used to isolate fluid passage between uphole and downhole annulus portions. For instance, the downhole packer 275 can use a mechanically-actuated or a hydrostatically-actuated packer.

To activate the compression-set packer 290, an activation is detected with the control unit 400, and the control unit 400 in turn initiates the activation of the packer 290. Any of a number of activations can be used. For example, the control unit 400 can be activated with any number of techniques—e.g., RFID tags in the flow stream may be used alone or with plugs; chemicals and/or radioactive tracers may be used in the flow stream; mud pressure pulses (if the system is closed chamber, e.g. gravel bridges off in the annular area between the assembly 220 and borehole); mud pulses (if the system is actively flowing); etc. Once activation is detected, the control unit 400 operates the packer's compression setting mechanism and compresses the packer's compressible element 292 to close off the wellbore annulus.

In one embodiment, the control unit 400 can include components as schematically illustrated in FIG. 9B. As shown, the control unit 400 includes a controller 402, which can include any suitable processor for a downhole tool. The controller 402 is operatively coupled to a sensor or reader 404 and to an actuator 406. The type of sensor or reader 404 used depends on how commands are conveyed to the control unit 400 while deployed downhole. Various types of sensors, readers 402, or the like can be used, including, but not limited to, a radio frequency identification (RFID) reader, sensor, or antenna; a Hall Effect sensor; a pressure sensor; a telemetry sensor; a radioactive trace detector; a chemical detector; and the like.

As an alternative to RFID, for example, the control unit 400 can be configured to receive mud pulses from the surface or may include an electromagnetic (EM) or an acoustic telemetry system, which includes a receiver or a transceiver (not shown). An example of an EM telemetry system is discussed in U.S. Pat. No. 6,736,210, which is hereby incorporated by reference in its entirety.

For the purposes of the present disclosure, reference to the control unit 400 and the sensor 402 will be to an RFID based system, which may be preferred in some instances. As will be appreciated, the sensor 402 for such an arrangement can be an RFID reader that uses radio waves to receive information (e.g., data and commands) from one or more electronic RFID tags 450, which can be active or passive, attached to a plug or other object, and deployed in the flow stream of the slurry. The information is stored electronically, and the RFID tags 450 can be read at a distance from the reader 402.

To convey the information to the packer apparatus 250 at a given time during operations, the RFID tags 450 are inserted into the slurry at surface level and are carried downhole in the fluid stream. When the tags 450 come into proximity to the packer apparatus 250, the electronic reader 402 on the tool's control unit 400 interprets instructions embedded in the tags 450 to perform a required operation. Further details of a radio-frequency identification (RFID) electronics package for the control unit can be found in WO 2010/054407, filed 10 Nov. 2009, which is incorporated herein by reference.

Logic of the controller 402 can count triggers, such as the passage of a particular RFID tag 450, a number of RFID tags 450, or the like. In addition and as an alternative, the logic of the controller 402 can use timers to actuate the actuator 406 after a period of time has passed since a detected trigger (e.g., after passage of an RFID tag 450 or after a previous operation is completed). These and other logical controls can be used by the controller 402.

When a particular activation is detected, for example, the controller 402 operates the actuator 406, which can be a switch or the like, to supply power from a power source 408 to a control's compression mechanism 410. The power source 408 can be a battery deployed downhole with the unit 400. The control's compression mechanism 410 can be a pump, a solenoid, a motor, or other mechanism.

The control's mechanism 410 (e.g., pump, solenoid, motor, etc.) couples to a packer's compression mechanism 414, which can be a valve, piston, or sleeve of the packer 250. For instance, the control's mechanism 410 can be operatively coupled between a pressure source or reservoir 412 and to the packer's compression mechanism 414. In this example, the pressure source or reservoir 412 can be a reservoir of fluid, and the control's mechanism 410 can be a pump activated by the power to pump fluid pressure against the packer's mechanism 414 (e.g., valve, piston, or sleeve). Alternatively, the pressure source or reservoir 412 may be fluid communicated from the packer's internal bore 254, and the control's mechanism 410 can be a solenoid 410 operated to open flow from the internal bore 254 to the packer's mechanism 414 (e.g., valve, piston, or sleeve). Additionally, the control's mechanism 410 may simply be a motor that moves the packer's mechanism 414 (e.g., valve, piston, or sleeve 414) compression-set the packer 275.

In the particular embodiment shown in FIG. 9A, for example, the control unit 400 connects an internal port 413 of the packer's bore 254 with a fluid passageway 415 to a piston chamber 299. When activation is detected from the RFID tag 250 or the like, the control unit 400, which can have a solenoid valve arrangement, opens fluid flow from the port 413 to the passageway 415. Fluid pressure from the internal bore 254 can then fill the piston chamber 299 and push the piston 296 to compress the compressible packing element 292 of the packer 275. Other arrangements of the control unit 400 as disclosed herein could also be used.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gravel pack assembly for a borehole, the assembly comprising:

a first screen section communicating an uphole annulus portion of the borehole with an interior passage of the assembly;

a second screen section communicating a downhole annulus portion of the borehole with the interior passage; and a packer apparatus disposed between the first and second screen sections, the packer apparatus comprising:

a housing having an internal bore and an internal bypass, the internal bore communicating with the interior passage of the assembly, the internal bypass communicating an uphole external port with a downhole external port on the housing, at least one transport tube having a distal end and a proximal end, the distal end communicating with the uphole annulus portion, the proximal end communicating with the uphole external port on the packer, a first packer disposed on the housing between the uphole and downhole external ports and at least restricting gravel passage from the uphole annulus portion to the downhole annulus portion, and a second packer disposed on the housing downhole from the downhole external port, the second packer being independently compressible and isolating fluid passage between the uphole and downhole annulus portions.

2. The assembly of claim 1, wherein the distal end of the at least one transport tube communicates with the uphole annulus portion at a point uphole of the first screen section.

3. The assembly of claim 1, wherein the packer apparatus comprises a manifold disposed about the housing at the uphole external port, the proximal end of the at least one transport tube communicating with the manifold.

4. The assembly of claim 1, wherein the uphole external port defines a tortuous path.

5. The assembly of claim 1, wherein the first packer comprises a cup packer element disposed on the housing and engaging an inside surface of the borehole.

6. The assembly of claim 1, wherein the second packer comprises a compressible packer element disposed on the housing, the compressible packer element being compressible with a mechanically-actuated mechanism, a hydrostatically-actuated mechanism, a hydraulically-actuated mechanism, or a combination thereof.

7. The assembly of claim 6, wherein the second packer comprises a sleeve disposed in the internal bore of the housing and mechanically moveable from a first position to a second position to compress the compressible packer element on the housing.

8. The assembly of claim 6, wherein the second packer comprises a piston disposed on the housing and hydraulically moveable from a first position to a second position in response to fluid pressure to compress the compressible packer element on the housing.

9. The assembly of claim 1, further comprising:

a tool disposed on a washpipe and sealing in the interior passage of the assembly, the tool having a through-bore, an inlet, and a valve, the through-bore communicating with the washpipe, the inlet communicating the interior passage of the assembly with the through-bore, the valve being movable from a closed condition to an opened condition relative to the inlet.

10. The assembly of claim 1, further comprising a control unit being electronically operable in response to at least one detected activation to compress the second packer.

11. The assembly of claim 10, wherein the control unit comprises:

a reader detecting a radio frequency identification tag as the at least one detected activation; and a compression mechanism operatively coupled to the reader and compressing the second packer in response to the detection of the radio frequency identification tag.

12. The assembly of claim 11, wherein the compression mechanism comprises:

a valve operable to communicate fluid pressure from the internal bore against a piston of the second packer;

a pump operable to pump fluid pressure against the piston of the second packer; or a motor operable to move the piston of the second packer.

13. The assembly of claim 10, wherein the control unit comprises a sensor responsive to a signal as the at least one detected activation.

14. The assembly of claim 13, wherein the sensor comprises a reader responsive to passage of at least one radio frequency identification tag.

15. A gravel pack assembly for a borehole, the assembly comprising:

a first screen section communicating an uphole annulus portion of the borehole with an interior passage of the assembly;

a second screen section communicating a downhole annulus portion of the borehole with the interior passage;

a packer apparatus disposed between the first and second screen sections, the packer apparatus comprising:

a housing having an internal bore and an internal bypass, the internal bore communicating with the interior passage of the assembly, the internal bypass communicating an uphole external port with a downhole external port on the housing, a first packer disposed on the housing between the uphole and downhole external ports and at least restricting gravel passage from the uphole annulus portion to the downhole annulus portion, and a second packer disposed on the housing downhole from the downhole external port, the second packer being independently compressible and isolating fluid passage between the uphole and downhole annulus portions; and a tool disposed on a washpipe and sealing in the interior passage of the assembly, the tool having a through-bore, an inlet, and a valve, the through-bore communicating with the washpipe, the inlet communicating the interior passage of the assembly with the through-bore, the valve being movable from a closed condition to an opened condition relative to the inlet, wherein the valve in the closed condition permits fluid returns from the downhole screen section to communicate through the through-bore of the tool to the washpipe; and wherein the valve in the opened condition permits fluid returns from the uphole screen section to communicate through the inlet of the tool to the washpipe.

16. The assembly of claim 15, wherein the first packer comprises a cup packer element disposed on the housing and engaging an inside surface of the borehole; and wherein the second packer comprises a compressible packer element disposed on the housing, the compressible packer element being compressible with a mechanically-actuated mechanism, a hydrostatically-actuated mechanism, a hydraulically-actuated mechanism, or a combination thereof.

17. The assembly of claim 15, further comprising a control unit being electronically operable in response to at least one detected activation to compress the second packer.

18. A method of packing an annulus of a borehole with gravel communicated in a slurry, the method comprising:

communicating slurry down the annulus around an assembly disposed in the borehole;

restricting passage of at least the gravel with a first packer element from an uphole portion of the annulus to a downhole portion of the annulus;

packing the gravel from the slurry around an uphole screen section on the assembly in the uphole annulus portion;

communicating, after packing the gravel around the uphole screen section, slurry from the uphole annulus portion to at least one transport tube having a distal end and a proximal end, the distal end communicating with the uphole annulus portion, the proximal end communicating with an internal bypass of the first packer element in the assembly;

communicating slurry from the at least one transport tube via the internal bypass of the first packer element in the assembly to an external port downhole of the first packer element;

packing the gravel from the slurry around a downhole screen section on the assembly in the downhole annulus portion; and isolating, after packing the gravel around the downhole screen section, fluid communication between the uphole and downhole annulus portions by compressing a second packer element disposed downhole of the external port of the assembly.

19. The method of claim 18, wherein communicating the slurry down the uphole annulus portion around the assembly comprises communicating the slurry with a cross-over tool disposed in the assembly.

20. The method of claim 18, wherein packing the gravel of the slurry around the uphole and downhole screen sections on the assembly in the uphole and downhole annulus portions comprises communicating fluid returns from the uphole and downhole screen sections through a washpipe disposed in the assembly.

21. The method of claim 18, wherein the first packer element comprises a cup packer disposed on the assembly between the at least one transport tube and the external port; and wherein restricting passage of at least the gravel with the first packer element from the uphole annulus portion to the downhole annulus portion comprises engaging the borehole with the cup packer.

22. The method of claim 18, wherein the second packer element comprises a compression-set packer disposed downhole of the external port on the assembly; and wherein compressing the second packer element disposed downhole of the external port of the assembly comprises activating the compression-set packer mechanically, hydraulically, hydrostatically, or electronically.

23. A method of gravel packing an annulus of a borehole with gravel communicated in a slurry, the method comprising:

sealing a section of a washpipe in an internal passage of an assembly disposed in a borehole, the washpipe having a through-bore, an inlet, and a valve, the inlet communicating the internal passage of the assembly with the through-bore, the valve being movable from a closed condition to an opened condition relative to the inlet;

communicating slurry down the annulus around the assembly disposed in the borehole;

restricting passage of at least the gravel with a first packer element from an uphole portion of the annulus to a downhole portion of the annulus;

communicating the slurry from the uphole annulus portion to the downhole annulus portion through an internal bypass on the assembly;

packing the gravel from the slurry around a downhole screen section on the assembly in the downhole annulus portion by taking fluid returns from the slurry up the through-bore of the washpipe, wherein the valve in the closed condition permits the fluid returns from the downhole screen section to communicate through the through-bore of the washpipe;

opening the valve to the opened condition on the washpipe uphole of the sealed section in the first internal passage of the assembly;

packing the gravel from the slurry around an uphole screen section on the assembly in the uphole annulus portion by taking fluid returns from the slurry through the open valve and up the through-bore of the washpipe, wherein the valve in the opened condition permits the fluid returns from the uphole screen section to communicate through the inlet to the through-bore of the washpipe; and isolating fluid communication between the uphole and downhole annulus portions by activating a second packer element disposed on the assembly between the uphole and downhole screen sections.

24. The method of claim 23, wherein communicating the slurry down the uphole annulus portion around the assembly comprises communicating the slurry with a cross-over tool disposed in the assembly.

25. The method of claim 24, wherein the internal bypass comprises an uphole external port uphole of the first packer element and a downhole external port downhole of the first packer element.

26. The method of claim 23, wherein the first packer element comprises a cup packer disposed on the assembly between uphole and downhole external ports of the internal bypass; and wherein restricting passage of at least the gravel with the first packer element from the uphole annulus portion to the downhole annulus portion comprises engaging the borehole with the cup packer.

27. The method of claim 23, wherein the second packer element comprises a swellable packer element disposed downhole of a downhole external port on the assembly; and wherein activating the second packer element comprises swelling the swelllable packer element with an activating fluid.

28. The method of claim 23, wherein the second packer element comprises a compression-set packer disposed downhole of a downhole external port on the assembly; and wherein activating the second packer element comprises compressing the compression-set packer mechanically, hydraulically, hydrostatically, or electronically.

* * * * *